US010243273B2

(12) United States Patent
Muesse et al.

(10) Patent No.: US 10,243,273 B2
(45) Date of Patent: Mar. 26, 2019

(54) SOLDIER-MOUNTED ANTENNA

(71) Applicant: Trivec-Avant Corporation, Huntington Beach, CA (US)

(72) Inventors: Allen R. Muesse, San Clemente, CA (US); Steven R. Mills, Mission Viejo, CA (US); John E. Fenick, Aliso Viejo, CA (US); Fernando J. Navarro, Chino, CA (US); David F. Macy, Mission Viejo, CA (US)

(73) Assignee: Trivec-Avant Corporation, Huntington Beach, CA (US)

( * ) Notice: Subject to any disclaimer, the term of this patent is extended or adjusted under 35 U.S.C. 154(b) by 0 days.

(21) Appl. No.: 16/027,084

(22) Filed: Jul. 3, 2018

(65) Prior Publication Data

US 2019/0006762 A1 Jan. 3, 2019

Related U.S. Application Data

(63) Continuation of application No. 15/640,219, filed on Jun. 30, 2017, now Pat. No. 10,020,585, which is a continuation of application No. 13/762,836, filed on Feb. 8, 2013, now Pat. No. 9,711,859.

(60) Provisional application No. 61/597,621, filed on Feb. 10, 2012.

(51) Int. Cl.

| | |
|---|---|
| ***H01Q 11/08*** | (2006.01) |
| ***H01Q 1/27*** | (2006.01) |
| ***H01Q 1/12*** | (2006.01) |

(52) U.S. Cl.

CPC ..... *H01Q 11/086* (2013.01); *H01Q 1/1235* (2013.01); *H01Q 1/273* (2013.01)

(58) Field of Classification Search

CPC .... H01Q 11/086; H01Q 1/1235; H01Q 1/273; H01Q 1/288; H01Q 1/362

See application file for complete search history.

(56) References Cited

U.S. PATENT DOCUMENTS

| | | | |
|---|---|---|---|
| 3,055,003 | A | 9/1962 | Marston et al. |
| 3,913,109 | A | 10/1975 | Owen |
| 4,053,896 | A | 10/1977 | Bitter, Jr. et al. |
| 4,780,727 | A | 10/1988 | Seal et al. |

(Continued)

FOREIGN PATENT DOCUMENTS

| | | |
|---|---|---|
| CN | 101783444 | 4/2018 |

OTHER PUBLICATIONS

Memry Corporation, Fabrication and Heat Treatment of Nitinol, http://www.memry.com/nitinol-ig/nitinol-fundamentals/fabrication-heat-tr . . . , (accessed Jan. 30, 2013) 1 page, 2012.

(Continued)

*Primary Examiner* — Robert Karacsony

(74) *Attorney, Agent, or Firm* — Knobbe Martens Olson & Bear LLP

(57) ABSTRACT

Embodiments of a wide band multi-polarization antenna system are described, which can be attached to the back or front of a soldier's vest or backpack. The antenna system can allow for release of pre-shaped integral radiating elements that spring into a geometric configuration suitable for circular polarization radiation or linear polarization over a desired band of frequencies. The antenna system can provide, when collapsed, linear polarized line-of sight capability over a wide band of frequencies. In a collapsed low-profile state, the antenna system can remain on the soldier, but out of the way for maneuvering.

20 Claims, 32 Drawing Sheets

(56) References Cited

U.S. PATENT DOCUMENTS

| | | | |
|---|---|---|---|
| 5,191,352 | A | 3/1993 | Branson |
| 5,668,565 | A | 9/1997 | Robinson |
| 5,963,180 | A | 10/1999 | Leisten |
| 5,977,932 | A | 11/1999 | Robinson |
| 6,094,178 | A | 7/2000 | Sanford |
| 6,150,984 | A | 11/2000 | Suguro et al. |
| 6,339,408 | B1 | 1/2002 | Edvardsson et al. |
| 6,906,683 | B2 | 6/2005 | Ikeda et al. |
| 7,236,681 | B2 | 6/2007 | Moheb et al. |
| 7,667,651 | B2 | 2/2010 | McKivergan |
| 8,339,326 | B2 | 12/2012 | Guler et al. |
| 9,711,859 | B1 | 7/2017 | Muesse et al. |
| 2005/0237256 | A1 | 10/2005 | Regala |
| 2008/0094307 | A1 | 4/2008 | Cowles |
| 2010/0102931 | A1 | 4/2010 | Nikitin et al. |
| 2010/0260076 | A1 | 10/2010 | Corman et al. |
| 2012/0026937 | A1 | 2/2012 | Chang |
| 2012/0280869 | A1 | 11/2012 | Kirkham |
| 2015/0333391 | A1 | 11/2015 | Pryor et al. |

OTHER PUBLICATIONS

Instruction Manual for P/N AV 2125-( ) UHF Satcom Antenna System, Document No. 2125-103 (retrieved Feb. 2, 2012) 2 pages.
Antenna Book, 21st Edition, Chapter 2, (retrieved Jan. 17, 2012) 6 pages.
The Quadrifilar Helix Antenna, Chapter 22, www.electroda.pl/rtvforum/download.php?id=291305, last accessed on Feb. 15, 2013, pp. 22-1-22-20.
Johnson Matthey Engineering Reference, Nitinol Products, 65 pages, 2004.
The ARRL Antenna Book, 21st Edition, Chapter 19, May 1, 2007, pp. 19-2-19-4.

SOLDIER-MOUNTED ANTENNA

RELATED APPLICATION

This application is a continuation of U.S. patent application Ser. No. 15/640,219, entitled "SOLDIER-MOUNTED ANTENNA" and filed on Jun. 30, 2017, which is a continuation of U.S. patent application Ser. No. 13/762,836, entitled "SOLDIER-MOUNTED ANTENNA" and filed on Feb. 8, 2013, which is a non-provisional application of and claims priority to U.S. Provisional Application No. 61/597,621, filed Feb. 10, 2012, each of which is hereby incorporated by reference herein in its entirety.

BACKGROUND

Wireless communication using radios can be used for communications on land, in the air, at sea, or on opposite sides of the world. Communication from point to point on the ground is commonly accomplished with antennas such as monopoles or dipoles. A dipole, for example, has two elements approximately a quarter wave in length, arranged in a shared axial alignment configuration with a small gap between the two elements. Each element of the dipole can be fed with a current 180 degrees out of phase from the other element. A monopole has one element approximately a quarter wave in length, and operates in conjunction with a ground plane, which mimics the missing second element.

Monopoles and dipoles are generally used for line-of-sight (LOS) communications. Obstructions such as mountains, or long distances, relative to the curve of the earth's surface between the transmitter and receiver, can prevent the reception of LOS electromagnetic signals. The relative positions and heights of the transmitter and receiver, as well as the power output of the transmitter and sensitivity of the receiver determine the total successful communication distance for LOS.

To overcome LOS communication distance limitations, satellite communications (SATCOM) has been developed. Orbiting satellites have transceivers that can relay communications back and forth from the earth's surface or to other satellites, allowing communication virtually anywhere in the world.

SUMMARY

For purposes of summarizing the disclosure, certain aspects, advantages and novel features of the inventions have been described herein. It is to be understood that not necessarily all such advantages can be achieved in accordance with any particular embodiment of the inventions disclosed herein. Thus, the inventions disclosed herein can be embodied or carried out in a manner that achieves or optimizes one advantage or group of advantages as taught or suggested herein without necessarily achieving others.

In certain embodiments, an antenna includes a support structure and a plurality of spring-loaded antenna elements coupled with the support structure. The antenna elements can be movable from a collapsed first configuration to a deployed second configuration. In the first configuration, the antenna elements can radiate a substantially linearly-polarized electromagnetic radiation pattern, and in the second configuration the antenna elements can radiate a substantially circularly-polarized electromagnetic radiation pattern. As a result, the antenna can communicate line-of-site in the first configuration and with a satellite in the second configuration. Further, the antenna elements can expand in the deployed second configuration.

In certain embodiments, an antenna includes a support structure and a plurality of antenna elements supported by the support structure. The antenna elements can be expandable from a collapsed first configuration to an expanded second configuration. In the first configuration, the antenna elements can radiate a first radiation pattern, and in the second configuration the antenna elements can be expanded into a quadrifilar helix that can radiate a second radiation pattern different from the first radiation pattern.

In certain embodiments, an antenna can include a support structure and a plurality of spring-loaded antenna elements coupled with the support structure. The plurality of spring-loaded antenna elements can be movable from a collapsed first configuration to an expanded second configuration. In the first configuration, the antenna elements can radiate substantially linearly-polarized electromagnetic radiation, and in the second configuration the antenna elements can radiate substantially circularly-polarized or elliptically-polarized electromagnetic radiation.

BRIEF DESCRIPTION OF THE DRAWINGS

Throughout the drawings, reference numbers can be reused to indicate correspondence between referenced elements. The drawings are provided to illustrate embodiments of the inventions described herein and not to limit the scope thereof.

DETAILED DESCRIPTION

I. Introduction

Figure 1:
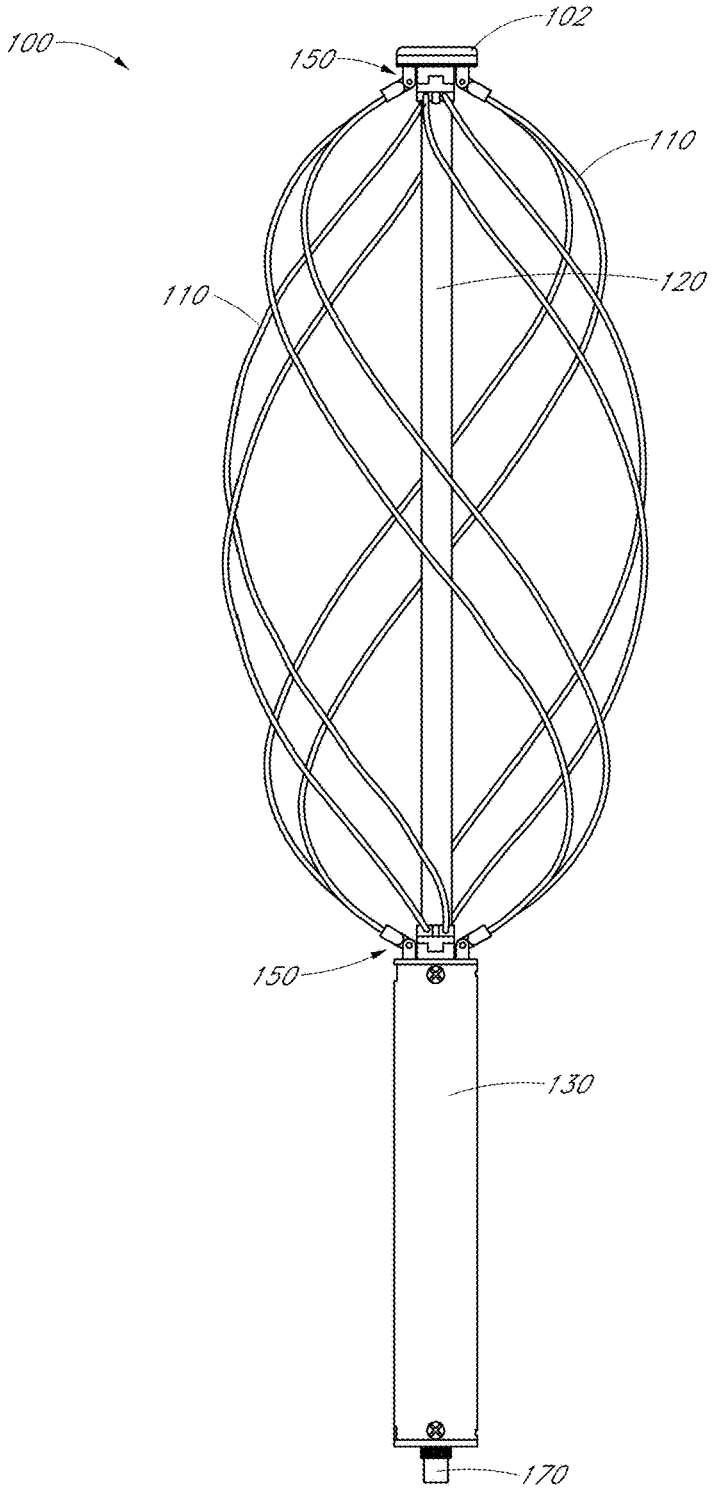
FIG. 1 is a front view of an embodiment of a dual-polarized antenna shown in a deployed configuration.

One of the characteristics of electromagnetic wave transmission relates to polarization. Wave polarization describes what physical plane the electromagnetic wave is being transmitted in. A dipole or monopole oriented in a vertical position (e.g., perpendicular to the earth's surface) radiates electromagnetic waves with a vertical polarization. For a second antenna to receive strong signal strength, it too can have a vertical orientation. As the receiving antenna is rotated away from vertical, its receive power diminishes until the antenna reaches a horizontal orientation (perpendicular to the transmit antenna orientation), at which time the received signal strength can be reduced to a null. This condition can be referred to as cross-polarization.

As satellites orbit the earth, their attached antennas transmit and receive electromagnetic waves to and from multiple directions with various antenna orientations. To compensate for the unknown relative orientations between ground and satellite antennas, satellite antennas are often designed to transmit and receive electromagnetic waves that are circularly polarized. The polarization of a transmitted radio wave is determined in general by the transmitting antenna physical shape (geometry) and feed type and its orientation. A circularly polarized electromagnetic wave signal is transmitted in a continuous right-hand or left-hand rotating orientation. One form of circularly polarized antenna has two dipoles arranged orthogonal to one another. The dipoles can be each equally driven by the radio with one driven by the waveform that is 90 degrees out of phase with the other. When viewed on a three-dimensional time vs. polarization graph, the circularly polarized signal resembles a spiral helix.

Due to the above-mentioned problem of cross-polarization, a linearly polarized ground antenna can suffer from a 50% signal loss when transmitting or receiving a satellite circularly polarized communication signal. To solve this signal loss problem, the ground antenna can advantageously also be a circularly polarized antenna to increase efficiency when used to transmit to or receive from a satellite.

Soldiers wish to communicate reliably and efficiently with others on land, in the air, at sea, or on opposite sides of the world. For such purposes, soldiers typically carry small tactical radios. Such tactical radios are mobile radios designed to be carried or worn on a person. Currently, soldier radios are used both on the move and at halt. These radios can have capabilities to utilize both a circular polarized antenna for satellite communication (SATCOM) and a linear polarized antenna for line of site (LOS) communications.

As described above, both linearly polarized antennas and circularly polarized antennas are known. However, carrying two separate antennas is cumbersome, especially for a soldier. Disconnection of the LOS antenna and connection of the SATCOM antenna is burdensome. Also, most SATCOM antennas require significant time for assembly or disassembly and are not suitable for use on the soldier on the move.

In the interests of convenience, utility and cost, it can be beneficial to provide a portable, lightweight, dual polarization, LOS/SATCOM antenna in the form of a single unit that can be soldier mounted and rapidly deployed from LOS configuration to the SATCOM configuration in the field.

Embodiments of antennas described herein can be mounted multi-purpose antennas for soldier (or civilian) use. These antennas may be transported or utilized in a compact configuration as a linear polarized omnidirectional LOS antenna and then quickly re-configured to be in a geometric shape for a circular polarized omnidirectional antenna for use for SATCOM. It should be understood that as used herein, the term "omnidirectional," in addition to having its ordinary meaning, when applied to antennas can refer to a pattern of radiation that has substantially low directivity and not necessarily an isotropic radiator. For example, a dipole or monopole LOS antenna may radiate in all or substantially all directions in an azimuthal plane perpendicular to the dipole and thus radiate "omnidirectionally," although a null may exist at the zenith of the radiation pattern. Similarly, embodiments of an antenna in a SATCOM configuration also radiate circular polarization omnidirectionally or substantially omnidirectionally, including in the zenith direction.

Such antennas can provide a soldier with a mountable, portable, easily transformable, dual polarization radio antenna. The dual-polarization antenna can be quickly deployed to either a circular polarization (CP) mode or a linear polarization (LP) mode. The antenna can include elements that can be expanded to achieve CP or LP mode. In the expanded configuration, the elements can radiate in the CP or LP mode, whereas in the collapsed configuration, the elements can radiate in an LP mode.

These and other purposes are achieved in certain embodiments by a portable supporting structure for a multi-element antenna formed by multiple folding elements pivotally connected to the mast. The mast base can be supported by an attachment structure that can be held into place by one or more fabric loops or pockets typically sewn to the backpack or vest webbing (among other possible attachment points). The fabric loops can allow for holding items such as the antenna support structure. The antenna system can then be fixed in a specific orientation or pointing in a satellite direction while mounted on the soldier. Alternatively, the antenna system can be held in a soldier's hand. The mast base may optionally connect to a tripod for deploying the antenna on the ground or other surface.

Embodiments of the antenna described herein can be considered either a dipole or a monopole in LP mode. In one embodiment, the antenna acts electrically like a dipole in which the radiating elements (deployed or collapsed) act as a monopole while other aspects of the antenna (such as the handle), the cable, and/or the radio or user act as a counterpoise to the monopole. Furthermore, in certain embodiments, the antenna described herein is not two antennas, but a single antenna having two (or more) communication modes.

II. Dual-Polarized Antenna Overview

Figure 2:
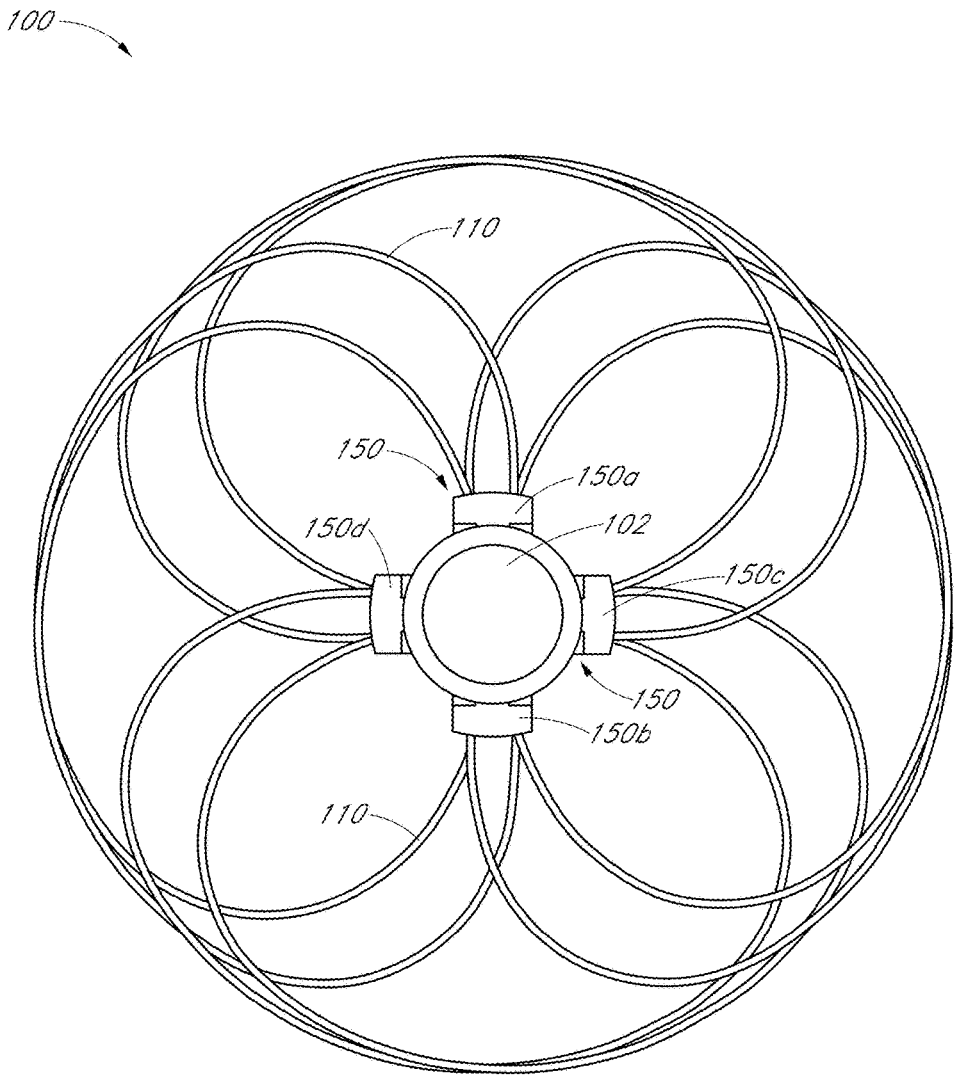
FIG. 2 is a top view of an embodiment of the dual-polarized antenna of FIG. 1.
Figure 3:
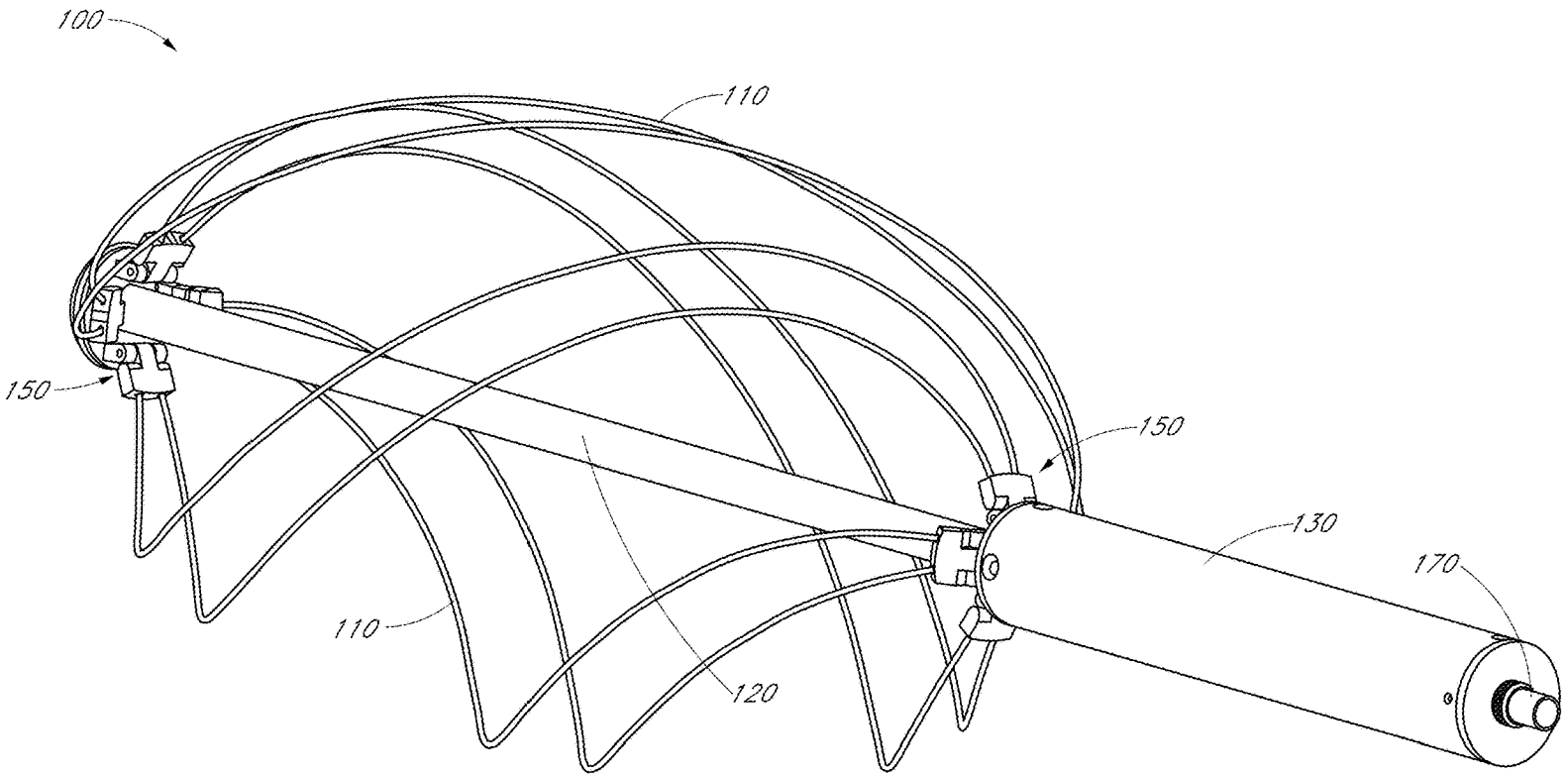
FIG. 3 is a side perspective view of an embodiment of the dual-polarized antenna of FIG. 1.

Referring to the Figures, FIGS. 1 through 3 illustrate aspects of an embodiment of a dual-polarized antenna 100.

In particular, FIG. 1 illustrates a front view of the antenna 100, FIG. 2 illustrates a top view of the antenna 100, and FIG. 3 illustrates a side perspective view of the antenna 100. The antenna 100 may be connected to an article of clothing, such as a soldier's vest or backpack, or may be handheld. Advantageously, the antenna 100 can be quickly and easily switched by a soldier on the move to radiate with substantially linear polarization or substantially circular (or elliptical) polarization.

The example antenna 100 shown includes a support structure having an end cap 102, a mast 120, and a base 130 (among possibly other components). Antenna elements 110 are attached to the support structure via pivot elements 150. In the example configuration shown, the antenna elements 110 can radiate with circular polarization, suitable for satellite communications. For convenience, this configuration is referred to herein as the deployed configuration. The antenna elements 110 can be collapsed or folded against the mast 120 to be transformed into a linearly polarized antenna, suitable for line-of-site communications (see, e.g., FIG. 4). In some cases, described below, the deployed configuration can also be suitable for LOS as well as SATCOM (at potentially some performance penalty over the collapsed LOS mode).

Figure 23A:
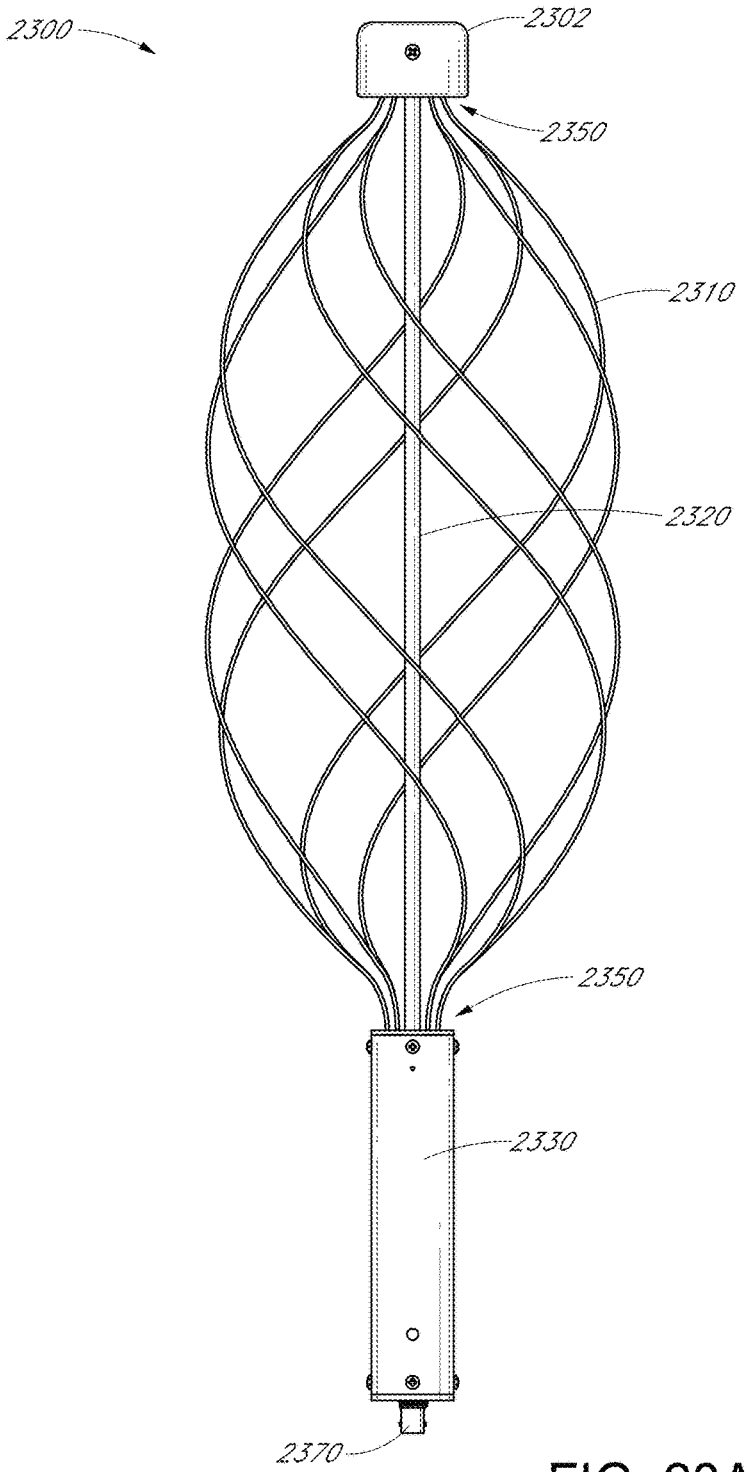
FIGS. 23A through 23C depict another embodiment of a dual-polarized antenna.
Figure 23B:
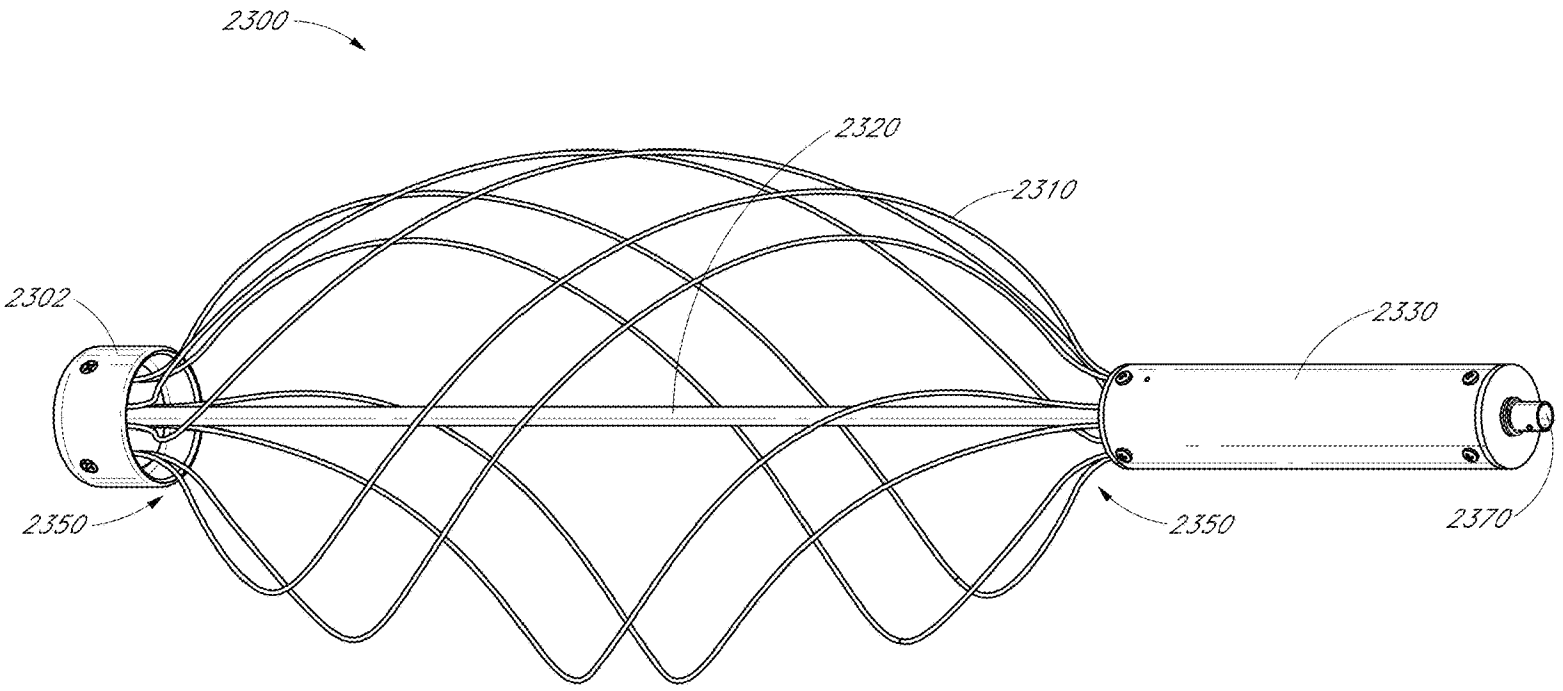
Figure 23C:
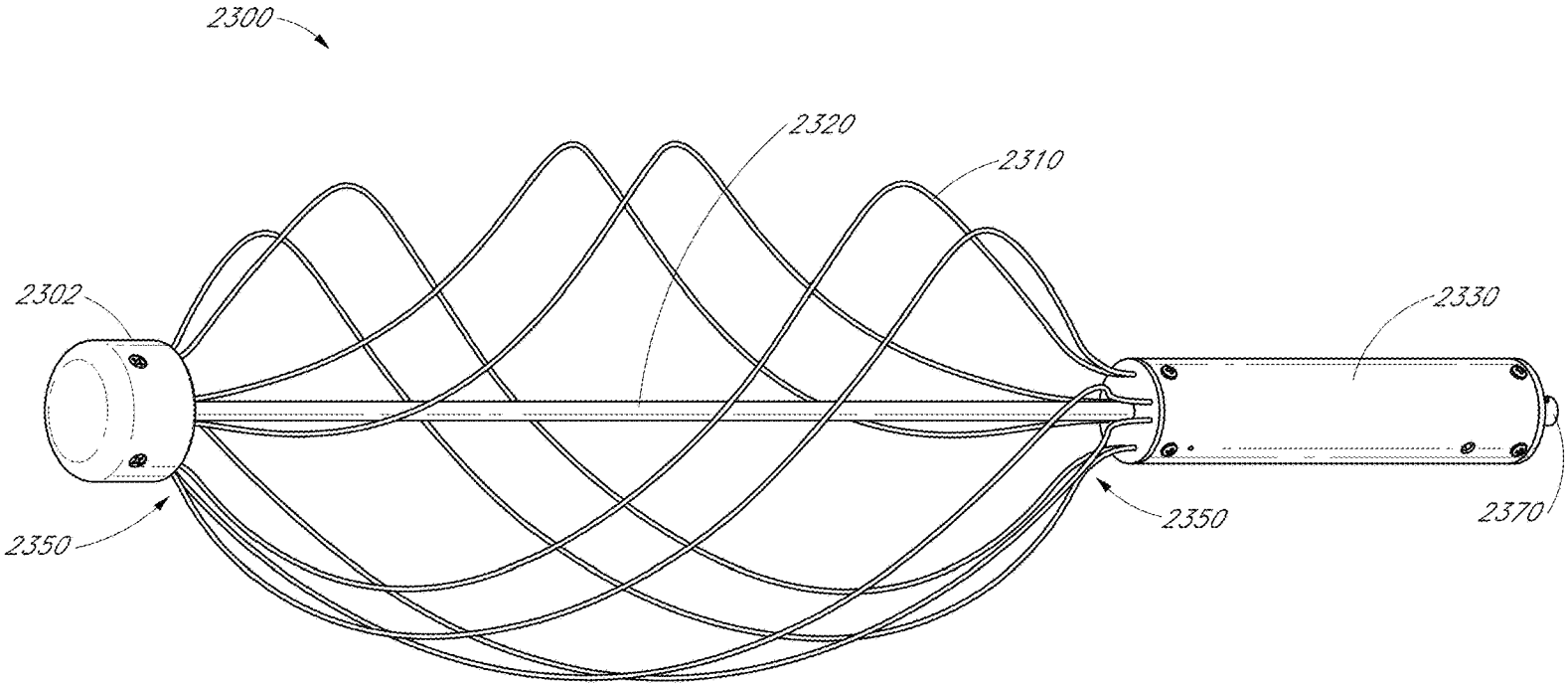

The antenna elements 110 can be collapsed and folded against the mast 120 due in part to pivoting action of the pivot elements 150 and stored against the mast 120 by application of a slip cover of a larger diameter than the base 130 (refer to FIGS. 4 through 6) or other mechanism (see, e.g., FIGS. 23A through 23C). The antenna elements 110 can remain positioned closely or relatively closely around the mast 120 while the antenna is in the collapsed configuration. The pivot elements 150 allow the antenna elements 110 to pivot when the elements 110 are moved toward or away from the mast 120, thereby enabling the antenna 100 to change from a collapsed configuration to a deployed configuration and vice versa.

The antenna elements 110 can be spring-loaded or manually-shaped by a user. Spring-loaded antenna elements 110, however, can advantageously allow for easier deployment of the collapsed elements 110 and holding of the deployed elements 110 in a geometric shape suitable for circular polarization. As seen in FIG. 1, in some embodiments, the antenna elements 110 are formed in a quadrifilar helix shape. Unlike existing quadrifilar helix antennas, however, the antenna elements 110 of the antenna 100 do not necessarily terminate in 90-degree angles at the top and base of the elements in some embodiments. Instead, the antenna elements 110 curve into the pivot elements 150, forming (together as a group) an ellipsoid, ovaloid, or football-like shape. This shape can advantageously provide excellent circular polarization characteristics while also allowing easier collapsing of the antenna elements 110 into the LOS configuration. Quadrifilar elements with 90-degree angles, in contrast, would be difficult to collapse against the mast 120. However, such 90-degree elements can be used in some embodiments, optionally with hinges or other flexure elements (such as springs) at the 90-degree angle points to facilitate collapsing the elements.

The quadrifilar antenna 100 shown can provide ease of use and comfort advantages over other circularly polarized antennas, such as crossed Yagis. Crossed Yagis can be more difficult or slower to deploy, with some antennas having separate parts that must be assembled. Crossed Yagis typically have reflector elements that can make for difficulty in mounting the antenna on the soldier. The quadrifilar antenna 100 can avoid these assembly problems, as the antenna 100 can be carried preassembled by a soldier. In addition, the antenna 100 can be lightweight and compact in the collapsed position, which may be a welcome change for soldiers who already typically carry 50-60 pounds of equipment. Further, crossed Yagi elements held by a soldier or attached to a soldier's clothing can snag on the soldier's clothing or dig into the soldier's body. In contrast, the elements 110 of the antenna 100 may be less prone to snag and have no elements that may protrude uncomfortably into a soldier.

Radiation from a quadrifilar helix antenna can be circularly or elliptically polarized. In some embodiments, the quadrifilar antenna elements 110 include two bifilar helical loops oriented in mutually orthogonal relation on a common axis (e.g., the mast 120). In some embodiments of SATCOM mode, the terminals or ends of each loop can be fed with signal current that is 180° out of phase, and the current in the two loops can be in phase quadrature (e.g., 90° out of phase). In contrast, in the LOS mode, each of the pairs of elements 110 can be driven together in phase as if the elements 110 were one lumped conductor, thereby achieving a dipole configuration (see, e.g., FIGS. 27 through 28C).

By selecting the appropriate shape of the helical loops in SATCOM mode, a wide range of radiation pattern shapes is available. In various embodiments, the geometric shape of each antenna element 110 may be a wire spiral helix element following the surface of an ellipsoid, a cylinder, a sphere, or an ovaloid. In some embodiments, the antenna elements 110 may each comprise a pair of closely spaced thin metal spiral helix elements following the surface of an ellipsoid, a cylinder, a sphere, or an ovaloid. In other embodiments, the antenna elements 110 may each comprise two, four, six, eight, or other number of pairs of closely spaced thin metal spiral helix elements. The spiral helix elements can be configured to spiral through an amount of twist of about 90° to about 270° over the ellipsoid, cylindrical, or spherical surfaces. An odd number of antenna elements may be used in some configurations of the antenna 100.

The pair of wires in each antenna element 110 can be driven together, in phase, in certain embodiments. For example, each wire in a pair can be electrically connected to the other wire in the pair. Using pairs of wires for the antenna elements 110 can have advantages over other configurations. The parallel or substantially parallel wires can effectively act as a larger conductor, thereby having a lower Q factor than a single, smaller conductor. This lower Q factor can facilitate easier impedance matching over a wider range of frequencies than if a single or smaller conductor were used for each element. Having a wide frequency range can facilitate using the antenna 100 in both LOS and SATCOM modes over a wide range of military (or other) frequencies. However, in other embodiments, blade conductors or single wires can be used in place of the paired wire antenna elements 110.

Additional practical benefits of using conductor pairs instead of larger conductors (such as blades) can include reduced carrying weight and lower visibility, both useful attributes for soldiers. The visibility of the antenna 100 can further be reduced by painting the antenna 100 (including the elements 110) black or camouflage.

In various embodiments, the antenna elements 110 may be produced using pre-shaped or shapeable nickel titanium (NiTi or nitinol) alloy memory metal. An example process for shaping the memory metal is described in greater detail below. Using such materials, the antenna elements 110 can be stored in a minimal profile geometric configuration when collapsed along the mast and can hold the SATCOM or LOS geometric configuration when deployed out from the mast 120. In some embodiments, the material used to produce the antenna elements 110 may include copper, iron, niobium, hafnium, cobalt, nickel-titanium cobalt, combinations of the same, or the like. In other embodiments, the material may also include alloys of superelastic memory metal, such as any combination of the following: AgCd, AuCd, CuAlNi, CuSn, CuZn, InTi, NiAl, FePt, MnCu, and FeMnSi. In yet other embodiments, the material may also include spring steel or beryllium-copper. In another embodiment, the material can be or include piano wire. Any combination of the materials described herein can be used to produce the antenna elements 110.

The base 130 can include a switch mechanism (not shown), which can be used to select impedance matching for either LOS or SATCOM (see, e.g., FIGS. 8, 27, and 28) when the antenna elements 110 are expanded from the mast 120. The switch mechanism can be configured to switch between two antenna impedance matching circuits based on desired use: one matching circuit for the circularly polarized configuration and one matching circuit for the linear polarization configuration. An electrical connector 170 at the bottom of the base 130 can be connected by a cable, such as a coax cable, to a radio for transmission/reception. One example type of electrical connector 170 that can be used is a BNC connector, although other connector types may also be employed. The electrical connector 170 may also be placed in another location of the base 130 other than the bottom thereof.

The mast 120 may be made of a rigid or semi-rigid material to support the antenna. In some embodiments, however, the mast 120 is omitted as the antenna elements 110 may be rigid enough to substantially hold their shape in either the collapsed or deployed configuration. The antenna elements can be designed to have sufficient thickness to provide enough rigidity to hold their shape in either configuration.

As mentioned above, FIG. 4 depicts an embodiment of the antenna (200) shown in a collapsed linearly-polarized LOS configuration. In this embodiment, the antenna 200 includes a slip cover 280 that covers or at least partially covers the antenna elements 110 and mast 120 shown in FIGS. 1-3. With the slip cover 280 covering the antenna elements 110, the elements 110 are collapsed against the mast 120 and therefore form a substantially cylindrical structure that can radiate with linear or substantially linear polarization.

The slip cover 280 may be attached to the base 130, for example, at the bottom of the base 130, and optionally extend up to the top of the antenna 100 above the end cap 102. The slip cover 280 may cover less than the full length of the antenna 100 in some embodiments. Further, the slip cover 280 may be detached from the antenna 100 or attached at the top of the antenna (e.g., at the end cap 102) in other embodiments. The slip cover 280 is an example of a tube, and in particular, a soft tube or fabric tube, that can at least partially cover the antenna elements 110. The slip cover 280 can be a nylon material or other material that is water resistant in some embodiments. An example hard tube that can cover the elements 110 is described below with respect to FIGS. 24 through 26. In some embodiments, the covering of the antenna elements 110 (and optionally base 130) can include any combination of materials, hard and soft, and can be considered a cover, tube, sheath, case, or the like.

Figure 4:
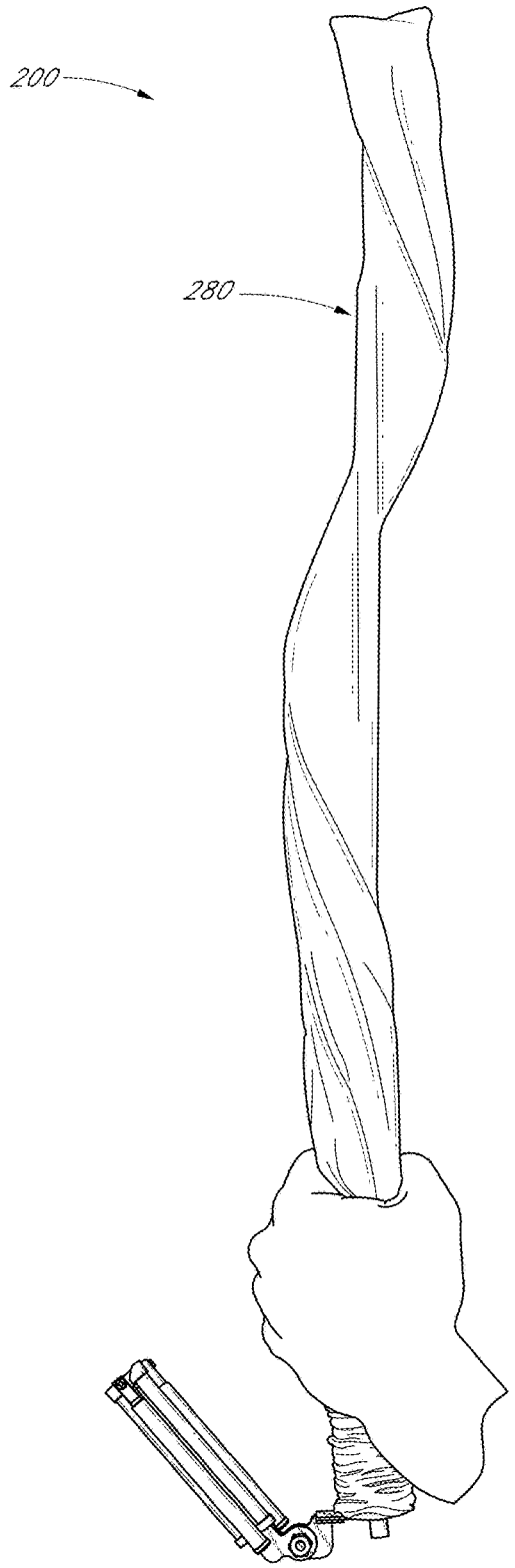
FIG. 4 is a front view of an embodiment of the dual-polarized antenna shown in a collapsed linearly-polarized configuration.

The antenna elements shown in FIG. 4 are twisted and collapsed against the mast 120 and therefore bear some resemblance to a dipole or monopole. However, the twisted shape of the elements 110 around the mast 120 also has some differences from the appearance of a straight dipole. Regardless of these differences in appearance, the antenna elements can still act electrically as a dipole (or monopole), radiating a pattern similar to that of a dipole (or monopole). Thus, in addition to having their ordinary meaning, terms such as "dipole" and "monopole," as used herein, can refer to antenna structures that have similar radiation patterns (or polarization) to a dipole or monopole even though their mechanical structure differs in some respects from some dipoles or monopoles.

III. Collapsed LOS to Deployed LOS OR SATCOM Mode Conversion

Figure 5:
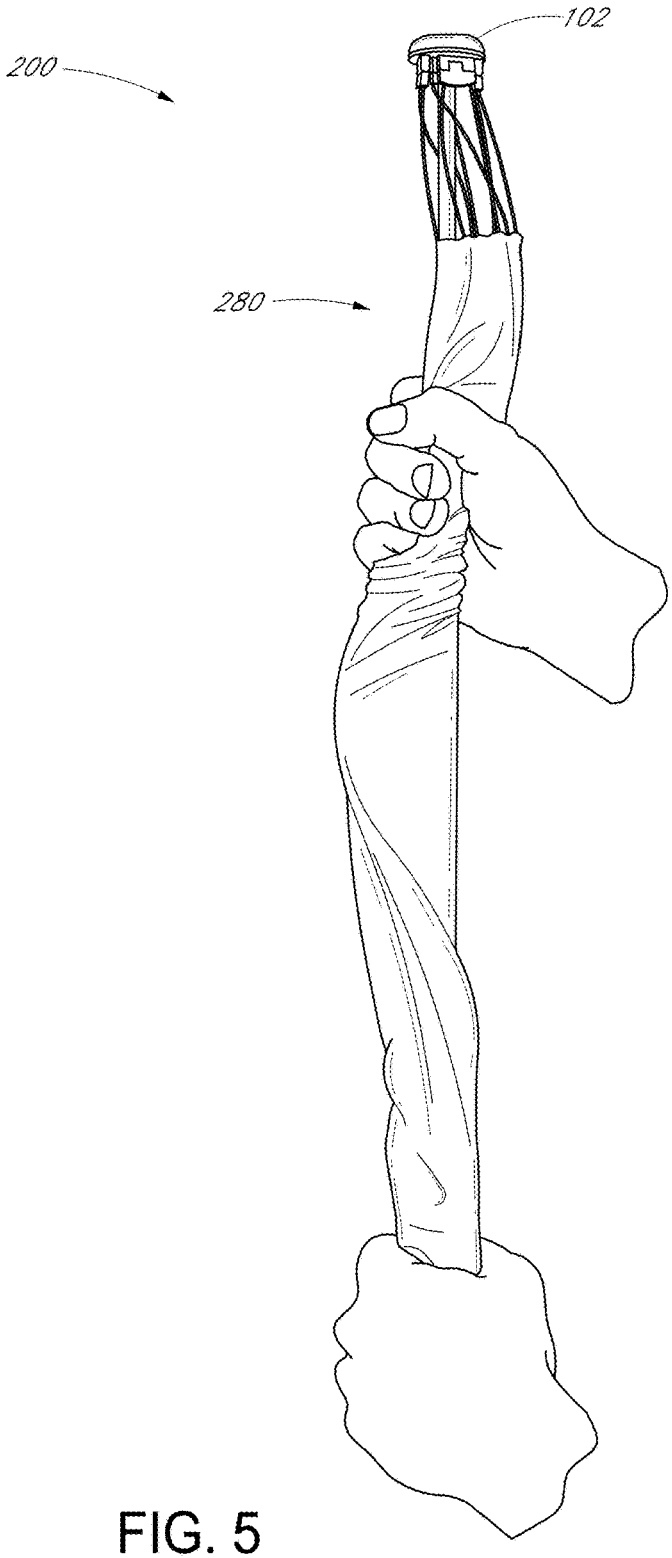
FIGS. 5 through 7 illustrate conversion of the dual-polarized antenna from a collapsed linearly-polarized configuration to a deployed circularly-polarized or linearly-polarized configuration.
Figure 6:
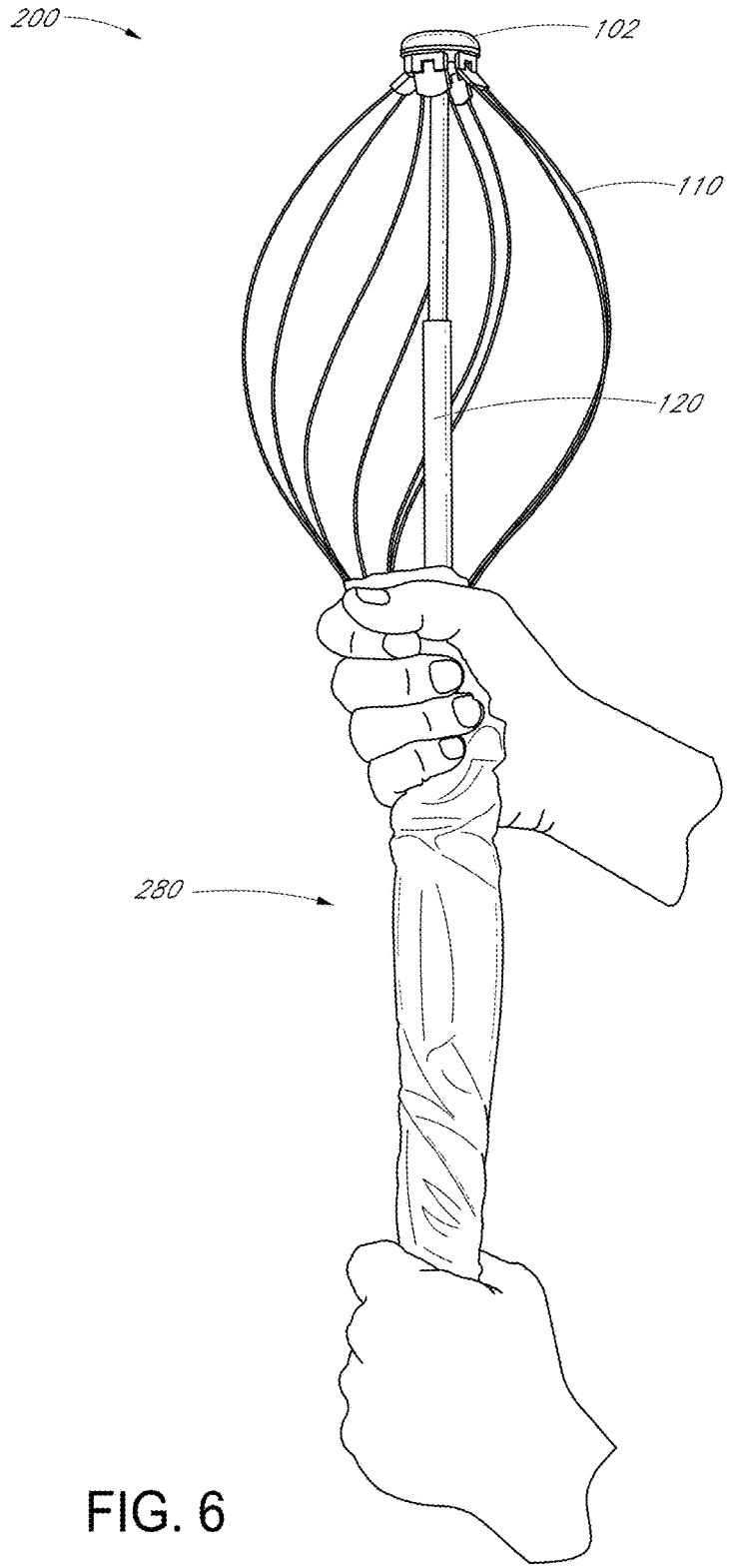
Figure 7:
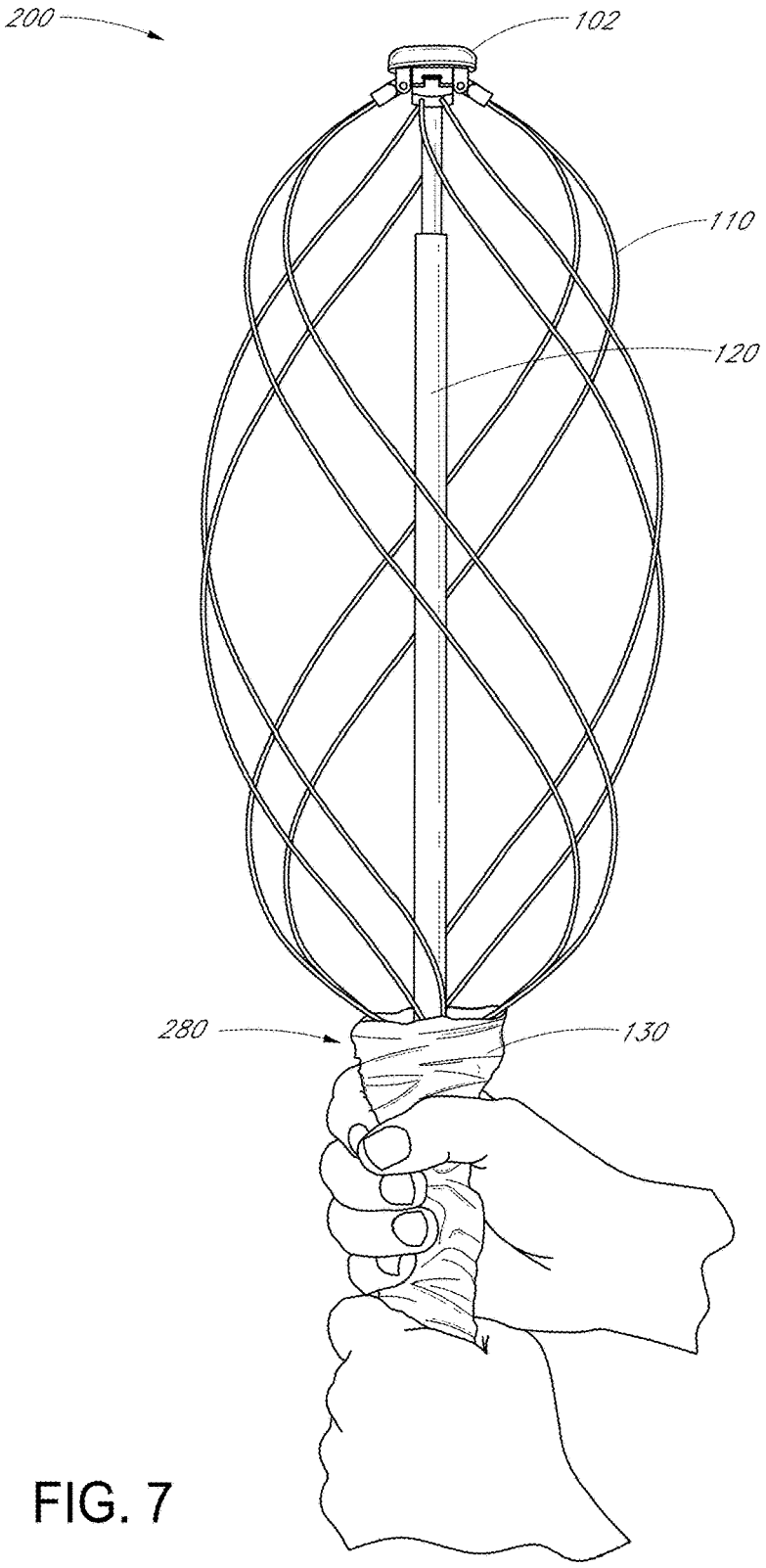

The slip cover 280 shown in FIG. 4 can be slipped off of or otherwise removed from the antenna elements 110 to allow the antenna elements 110 to resume a quadrifilar helical shape. The antenna elements 110 can automatically assume the quadrifilar helical shape in some embodiments because the elements 110 are spring-loaded and pivotably attached to the support structure via pivot elements 150. However, the pivot elements 150 are also optional in some embodiments (see, e.g., FIGS. 23A through 23C). FIGS. 5 through 7 illustrate conversion of the antenna 200 from a collapsed linearly-polarized LOS configuration to a deployed circularly-polarized SATCOM (or also optionally linearly polarized) configuration.

Referring to FIG. 5, the slip cover 280 is shown being pulled down from the antenna by a user's hands, exposing the end cap 102 of the antenna 200. As the slip cover 280 is pulled farther down toward the base 130, the antenna elements 110 and mast 120 are also exposed (FIG. 6). Further, the antenna elements 110 expand as the slip cover 280 is uncovers them in certain embodiments. In FIG. 7, the slip cover has been substantially removed from the antenna elements 110, thereby allowing the antenna elements 110 to spring open into a quadrifilar helical shape. The slip cover 280 can also be completely removed from the base 130 of the antenna 100 as well in some embodiments. In other embodiments, the slip cover 280 is attached to the base 130 to avoid loss of the slip cover 280.

Advantageously, in some embodiments, the slip cover 280 can be removed extremely rapidly, allowing for easy and rapid conversion from the collapsed to deployed configuration. The process can be reversed to switch from deployed to collapsed configuration by pulling the slip cover 280 over the antenna elements 110, causing the antenna elements 110 to collapse against the mast and form the LOS configuration shown in FIG. 4.

IV. Detailed Example Antenna Components

Figure 8:
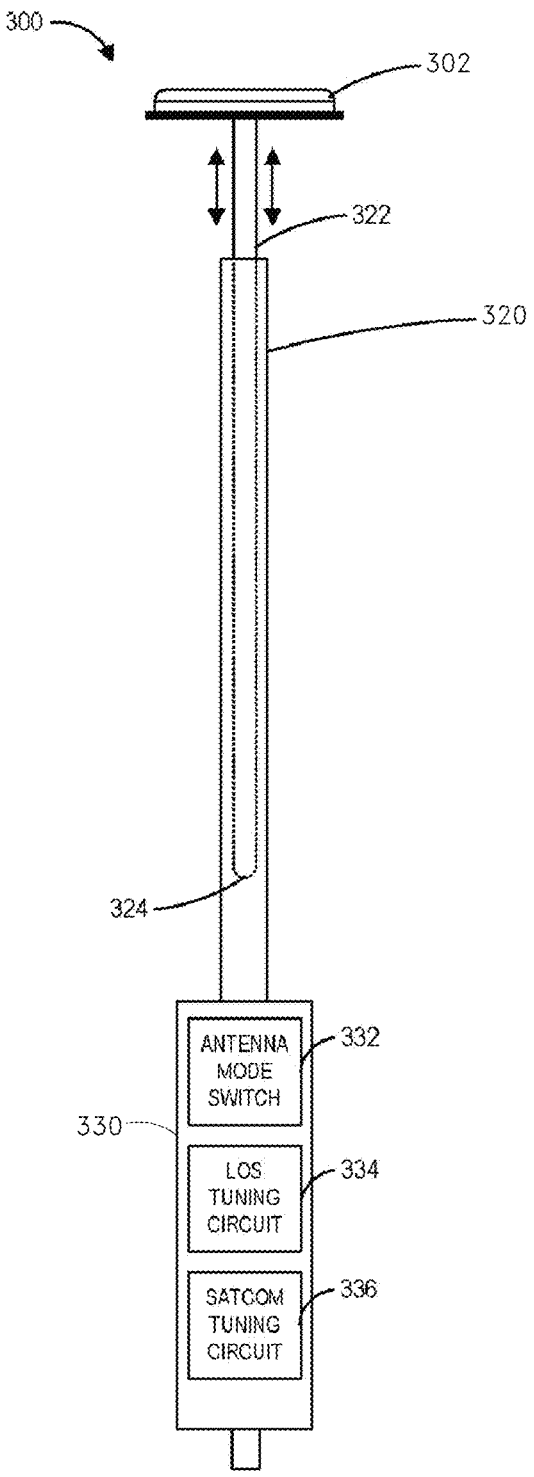
FIG. 8 illustrates an embodiment of a support structure that can be used by the dual-polarized antenna.

FIG. 8 illustrates an embodiment of a support structure 300 that can be included in an antenna, such as any of the antennas 100, 200 described above. Like the support structure described above with respect to FIG. 1, the support structure 300 includes an end cap 302, a mast 320, and a base 330. Additional aspects of the support structure 300 are illustrated in order to detail example operation of the antenna 100, 200. More detailed embodiments of the base 330 are described below with respect to FIGS. 27 and 28.

For example, the mast 320 (which can be formed as a tube or the like) includes a sliding rod 322 that can slide up and down within the mast 320. A portion of the sliding rod 322 is illustrated in phantom to depict its position inside the mast 320. The sliding rod 322 is connected to the end cap 302, which as shown in FIGS. 1 through 3, can be pivotably attached to the antenna elements 110. Thus, as the end cap 302 moves up, the antenna elements collapse against the mast 320, and as the end cap 302 moves down, the antenna elements 110 expand into quadrifilar shape. The sliding rod 322 can facilitate the compression and expansion of the spring-loaded antenna elements 110 by sliding and thereby allowing the mast 320 to change size while maintaining rigid or semi-rigid support for the antenna elements 110.

Various example components are also illustrated in the base 330, including an antenna mode (e.g., internal) switch 332, a LOS tuning circuit 334, and a SATCOM tuning circuit 336. The antenna mode switch 332 can be an electromechanical switch that selects between the LOS tuning circuit 334 and the SATCOM tuning circuit 336 for antenna tuning. In one embodiment, the antenna mode switch 332 is actuated mechanically by a tip 324 of the sliding rod 322 coming into contact with the antenna mode switch 332. In one embodiment, as the antenna elements 110 expand into the quadrifilar shape, the tip 324 of the sliding rod 322 moves toward the base 330 and actuates the antenna mode switch 332, causing the antenna mode switch 332 to select the SATCOM tuning circuit 336 to properly tune the antenna in SATCOM mode. If the antenna elements 110 are then collapsed toward the mast 320, the tip 324 of the sliding rod 322 is pulled away from the antenna mode switch 332, causing the antenna mode switch 332 to select the LOS tuning circuit 334 to properly tune the antenna in LOS mode.

In another embodiment, the antenna mode switch 332 is actuated by the soldier using a mechanical switch (e.g., a slide switch), which may be attached to the base 130. In response to a soldier sliding the antenna mode switch 332 to a first position, the SATCOM tuning circuit 336 can be selected to properly tune the quadrifilar antenna in SATCOM mode. In response to sliding the antenna mode switch 332 to a second position, the antenna mode switch 332 selects the LOS tuning circuit 334 to properly tune the antenna in LOS mode. A drive circuit may also be included in either tuning circuit.

Figure 9:
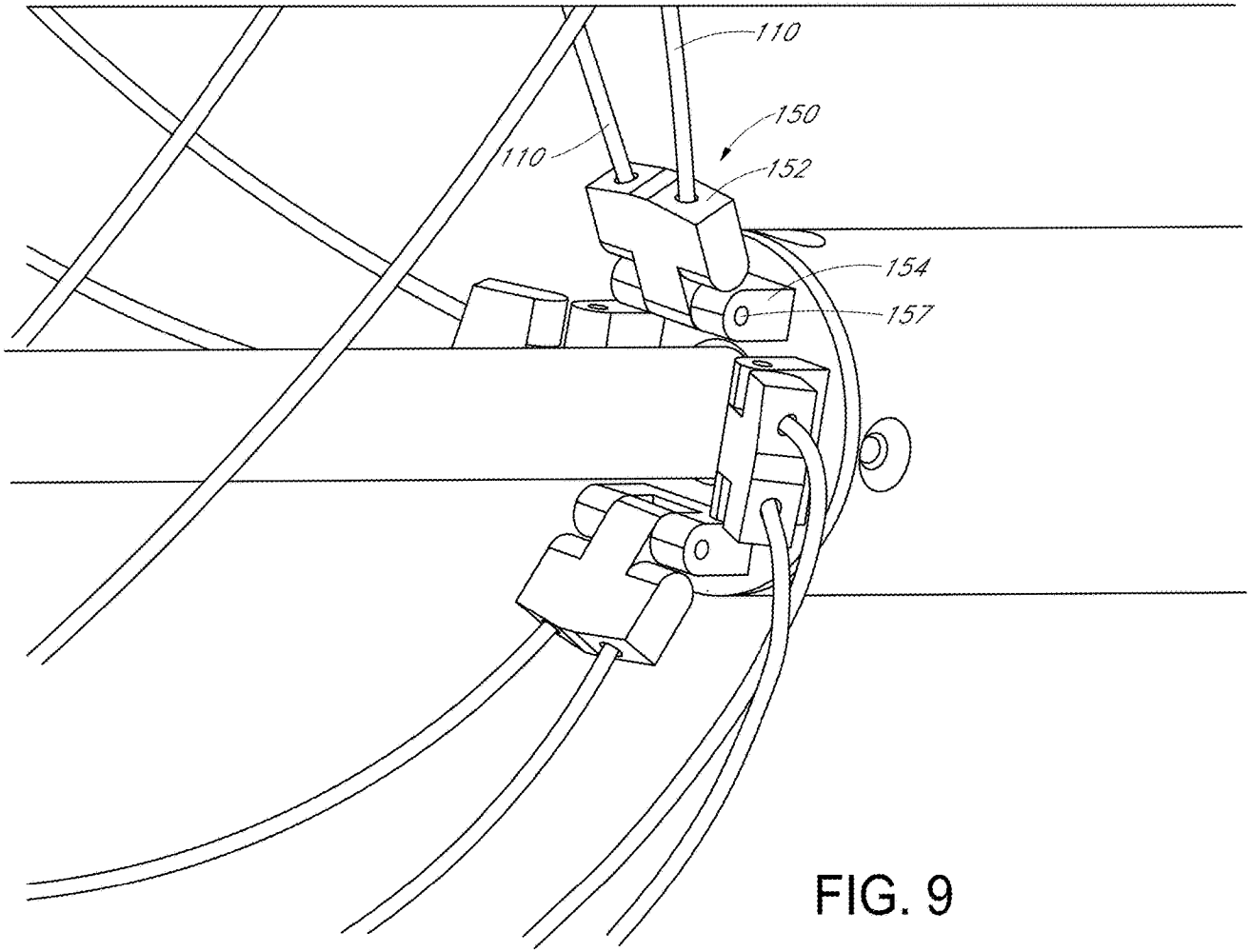
FIG. 9 illustrates a close-up view of an embodiment of a structure that can be used to connect movable elements of the antenna to a fixed portion of the antenna.

FIG. 9 illustrates a close-up view of an embodiment of the pivot elements 50 (see FIGS. 1-3 above). The pivot elements 150 shown connect an embodiment of the antenna elements 110 mechanically and electrically to the base 130. An alternative embodiment of the antenna elements 110 that does not have pivot elements 150 is described below with respect to FIG. 23.

The pivot elements 150 can be hinged or otherwise flexural members having an antenna element receptacle 152 and a base connection member 154. A hinge pin 157 or the like connects the base connection member 154 with a corresponding antenna element receptacle 152. The antenna element receptacle 152 can hold the antenna elements 110 in place with a friction fit, an adhesive, a set screw, combinations of the same, or the like. The antenna element receptacles 152 and base connection members 154 of the pivot elements 150 can be made of metal, allowing current to pass from the circuitry in the base 130 to the antenna elements 110. In some embodiments, a small gap may exist between the antenna element receptacles 152, the base connection members 154, and the hinge pin 157. Regardless, capacitive coupling between the various components 152, 154, 157 can allow RF signals to pass between the antenna elements 110 and circuitry in the base 130. The base connection members 154 can be electrically connected to the circuitry in the base 130 in a variety of ways, such as by solder joints, screws connected to the members 154 and circuitry, combinations of the same, or the like. In one embodiment, the pivot elements 150 are anodized black or camouflage for concealment purposes, except that the pin 157 and holes in the elements 150 are not anodized to allow current to pass through.

The pivot elements 150 that connect the antenna elements 110 to the end cap 102 are not shown in detail but can have the same or a similar structure as the pivot elements 150. However, the end cap 102 can include electrical connections (e.g., on a circuit board or through wiring) between antenna elements 110. In one embodiment, opposing antenna elements connect to each other. For example, referring to FIG. 2, pairs of antenna elements 110 connected to opposing pivot elements 150*a*, 150*b* can be connected in (or about) the end cap 102. Likewise, pairs of antenna elements 110 connected to opposing pivot elements 150*c*, 150*d* can be connected in (or about) the end cap 102. Each opposing pair of antenna elements 110 can therefore form a loop in the SATCOM expanded configuration.

Figure 14:
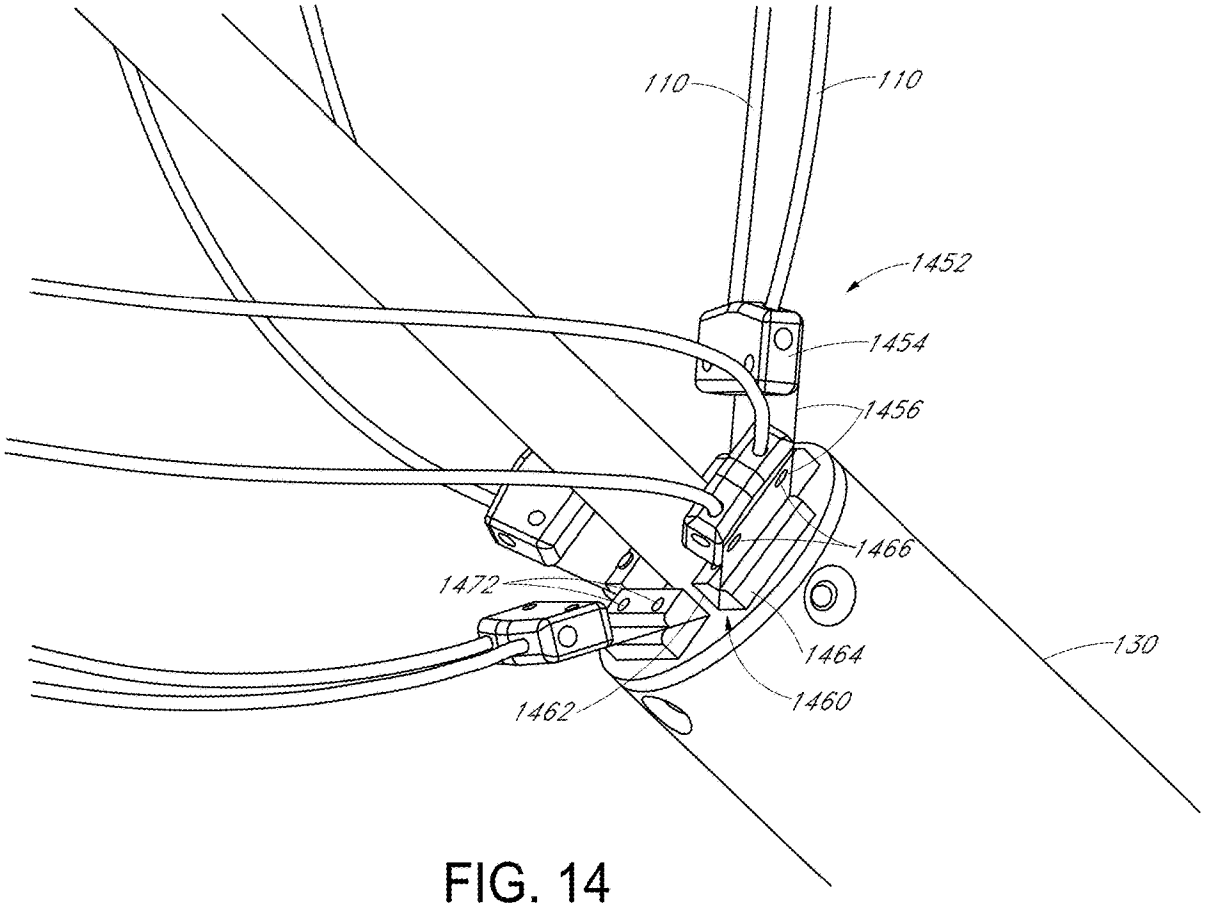
FIG. 14 illustrates a close-up view of another embodiment of a structure that can be used to connect movable elements of the antenna to a fixed portion of the antenna.
Figure 15:
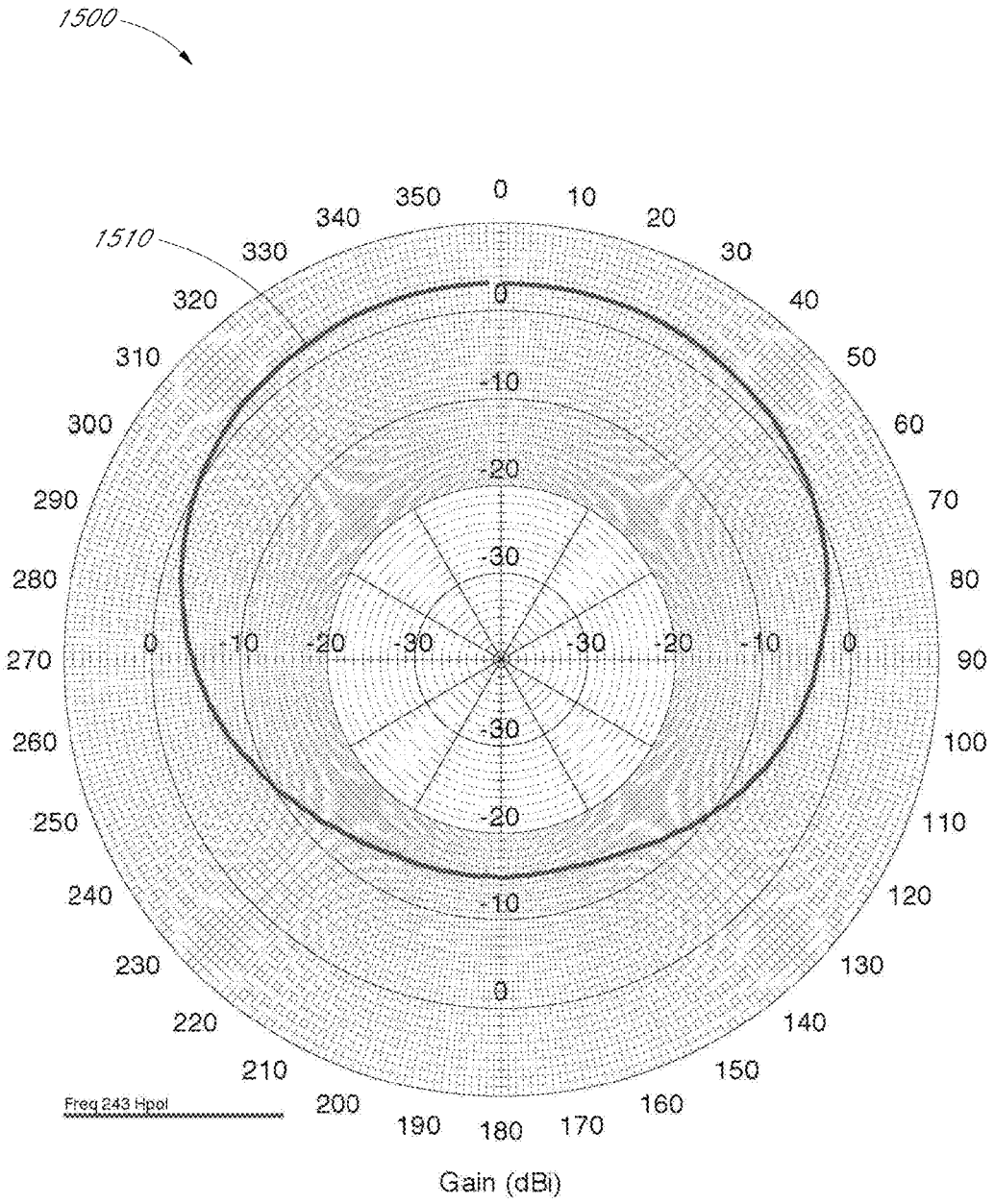
FIGS. 15 through 22 illustrate example antenna radiation patterns that can be produced by embodiments of the dual-polarized antenna in SATCOM mode.
Figure 16:
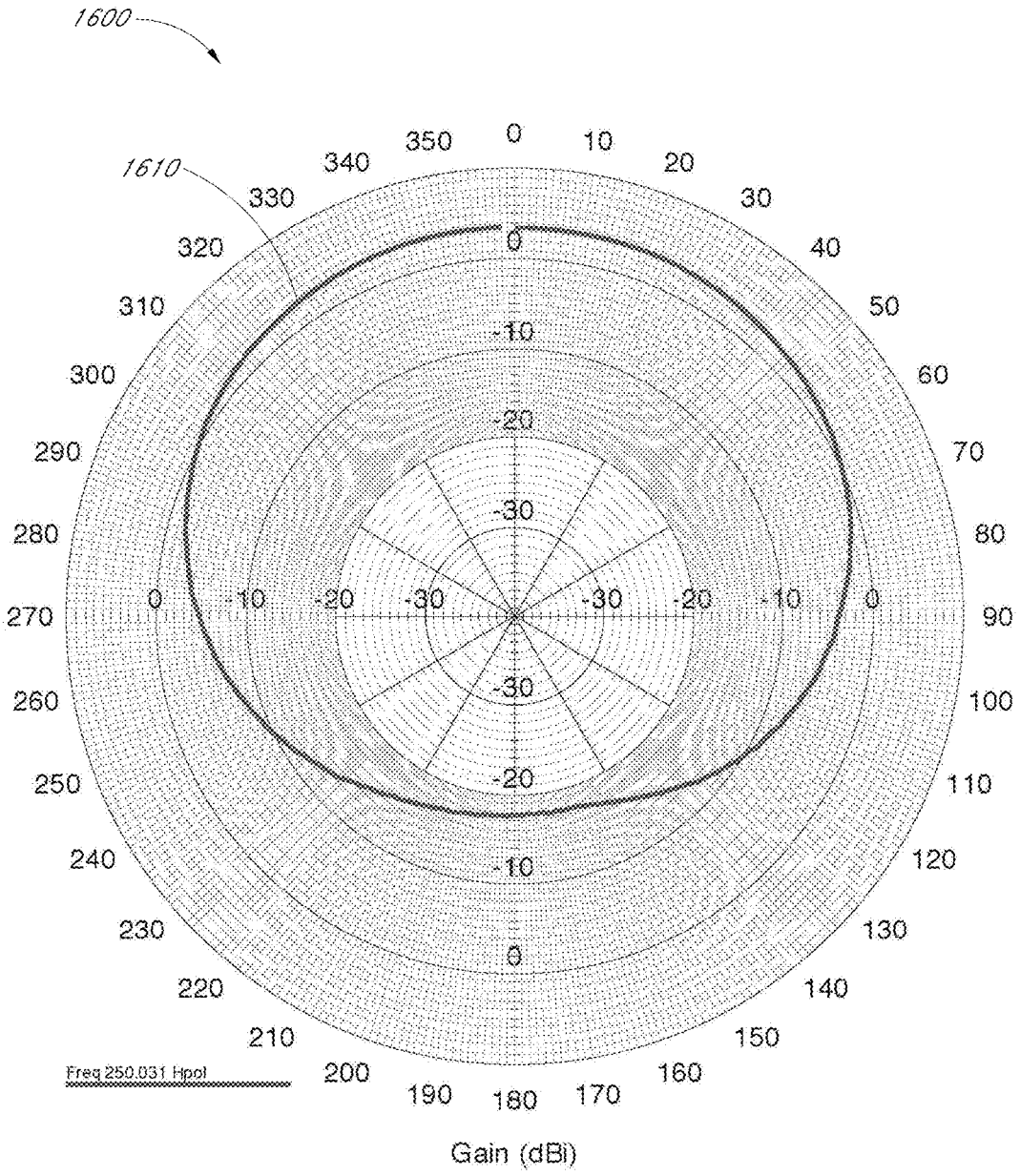
Figure 17:
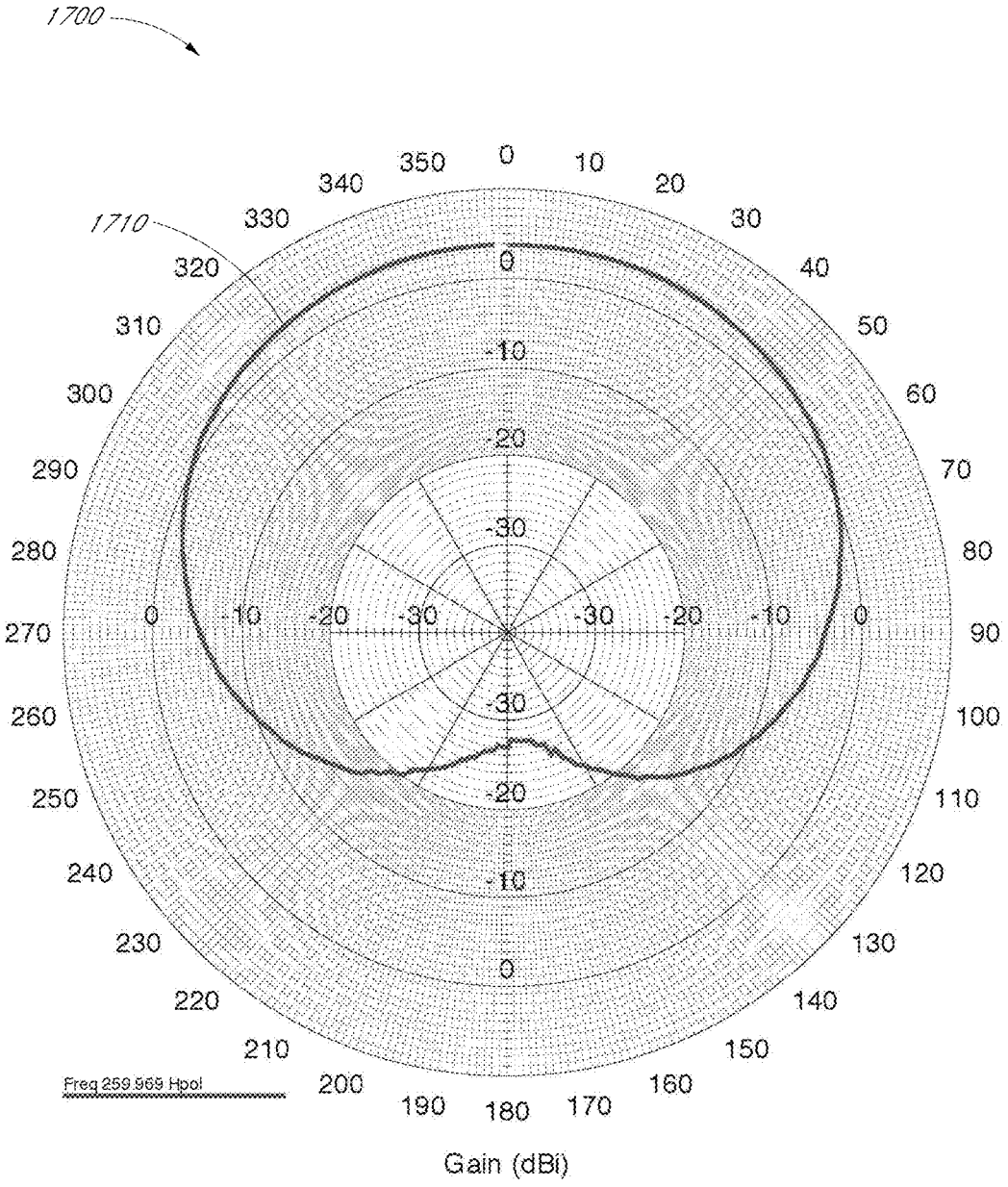
Figure 18:
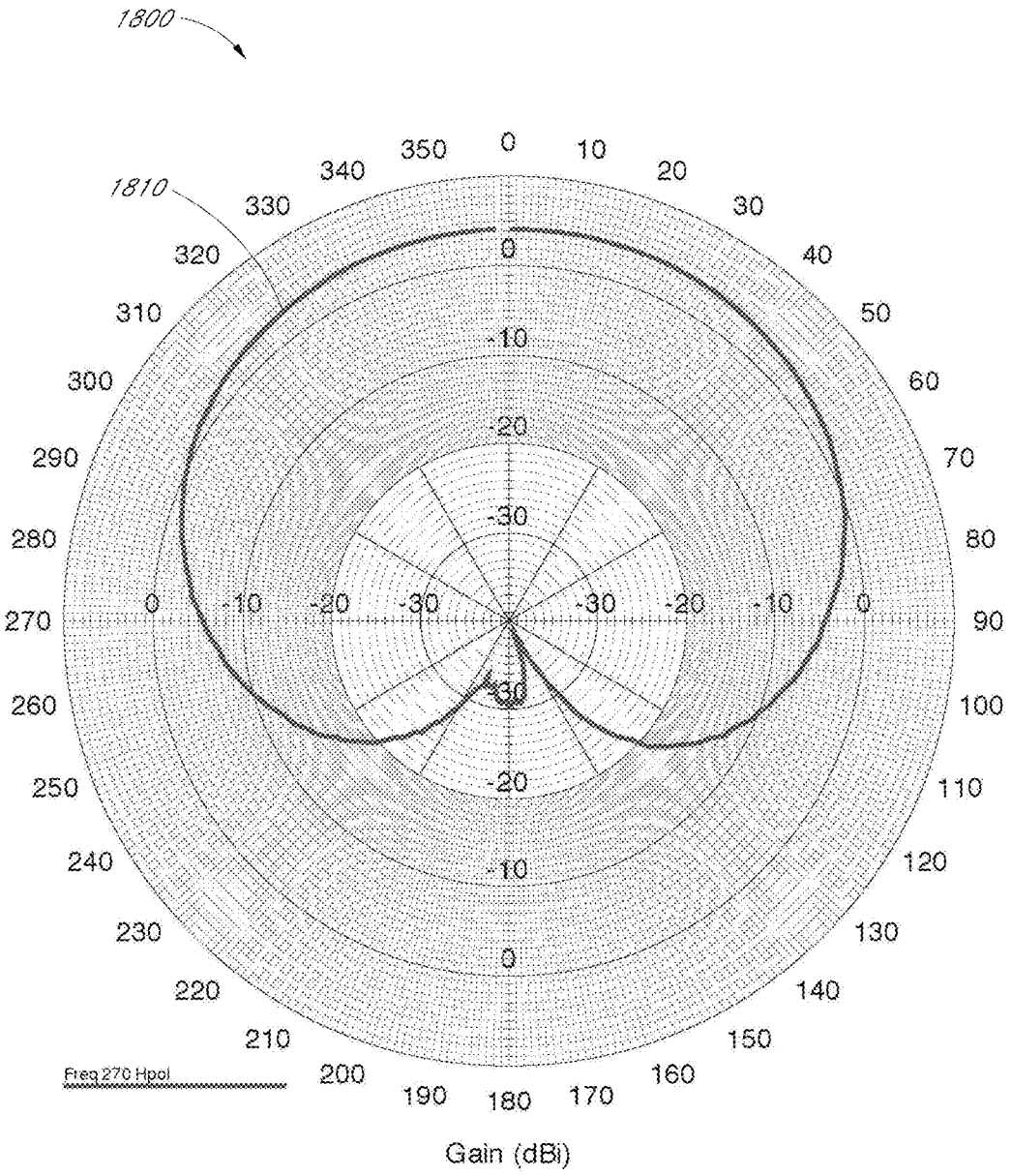
Figure 19:
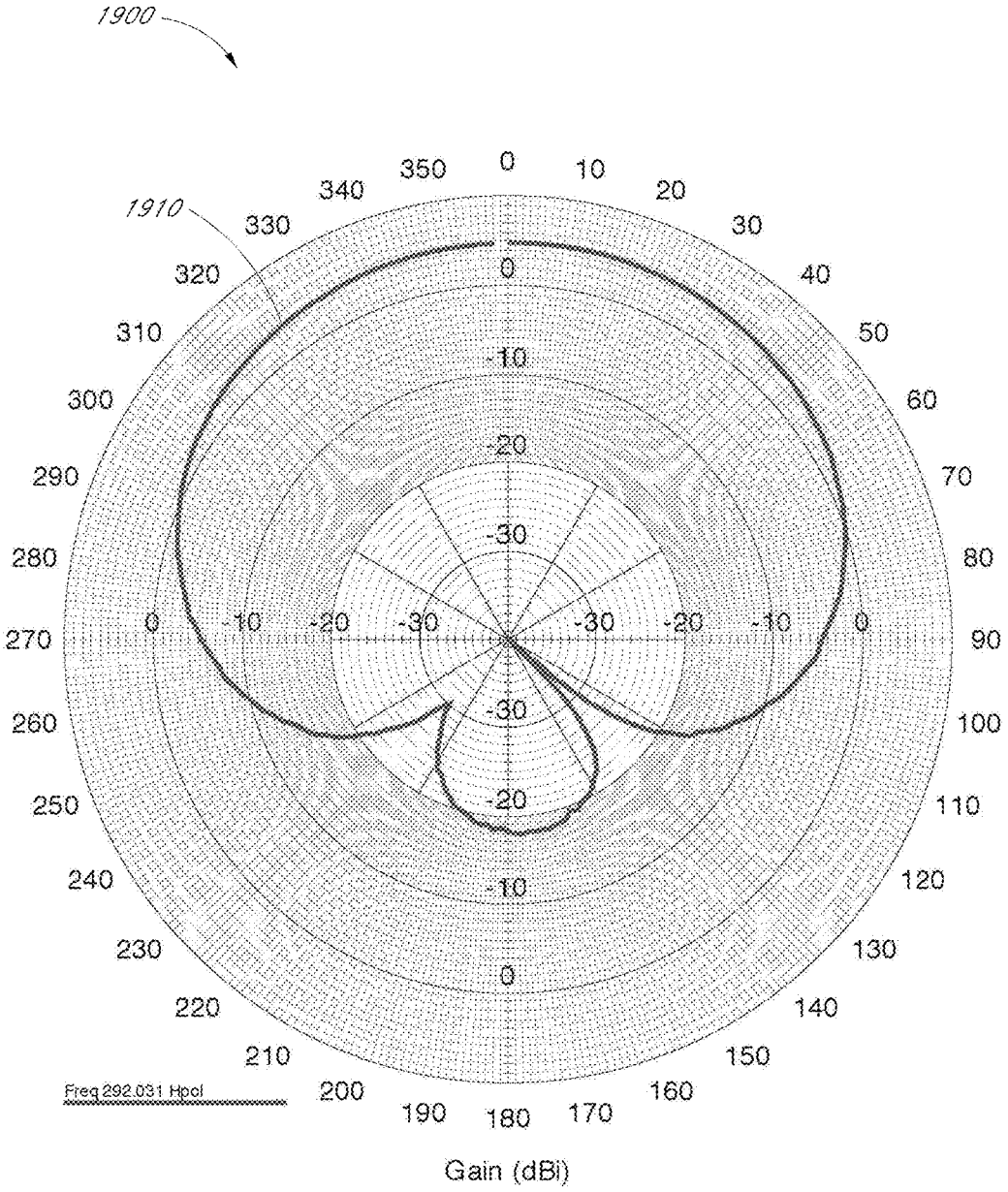
Figure 20:
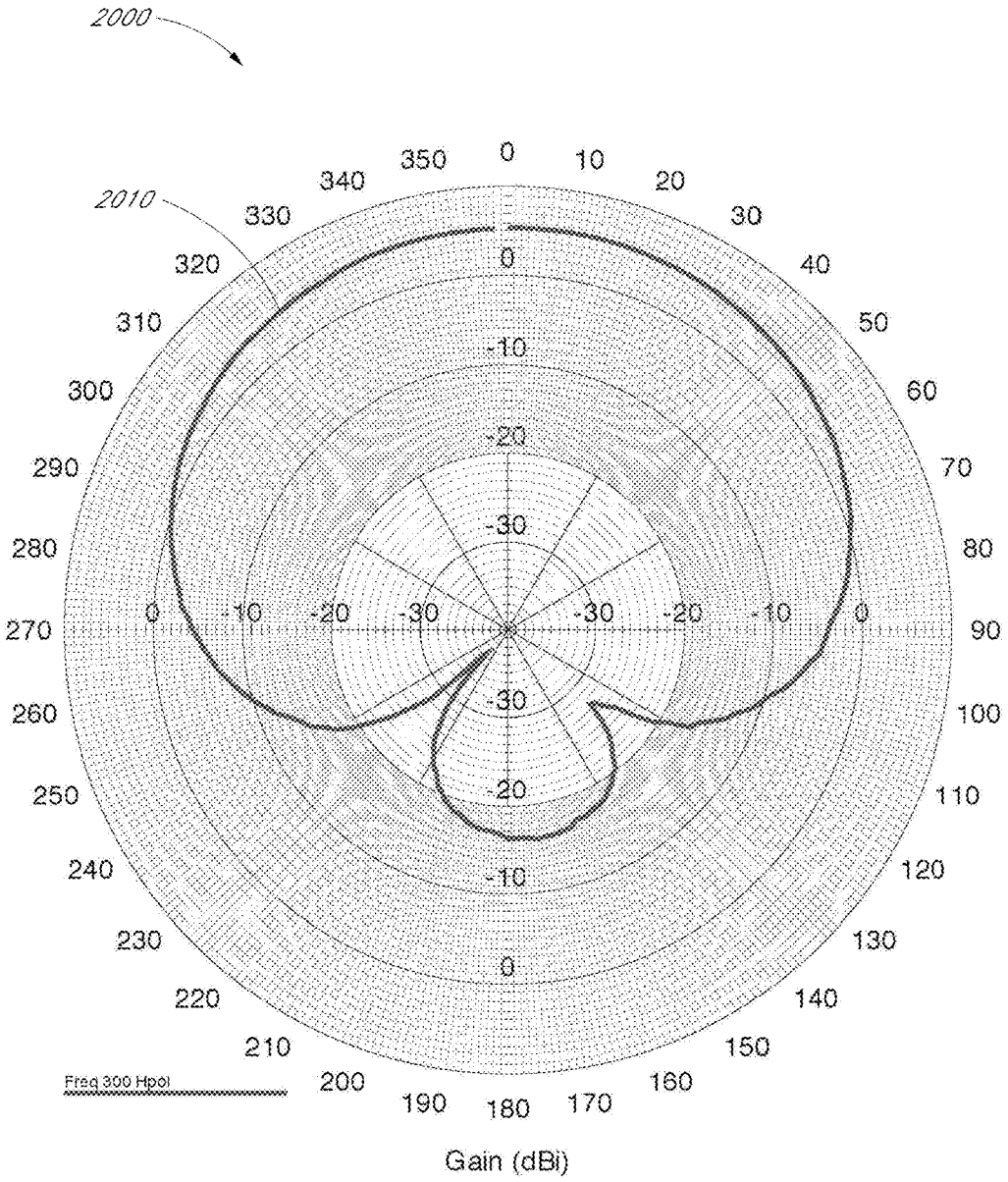
Figure 21:
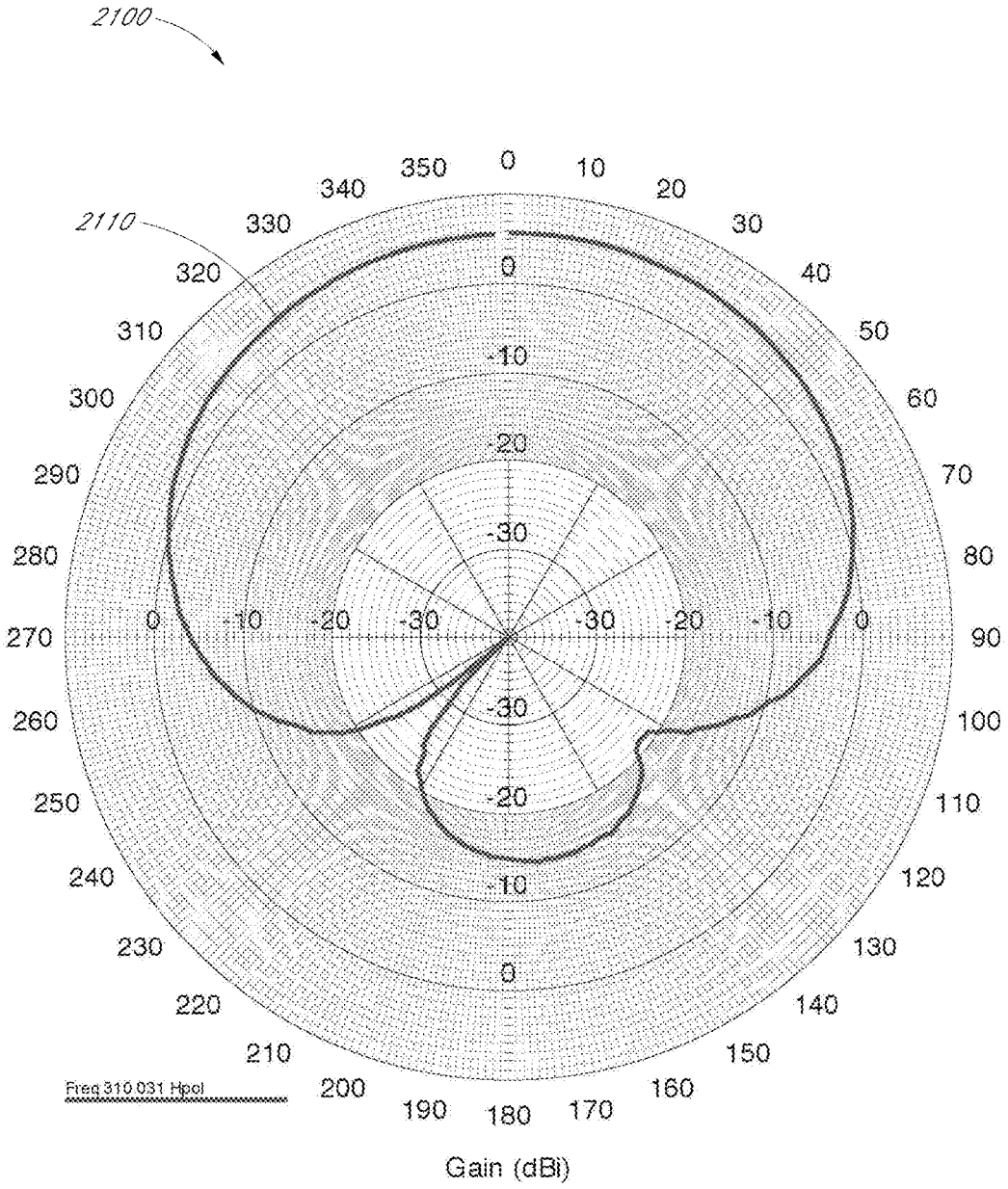
Figure 22:
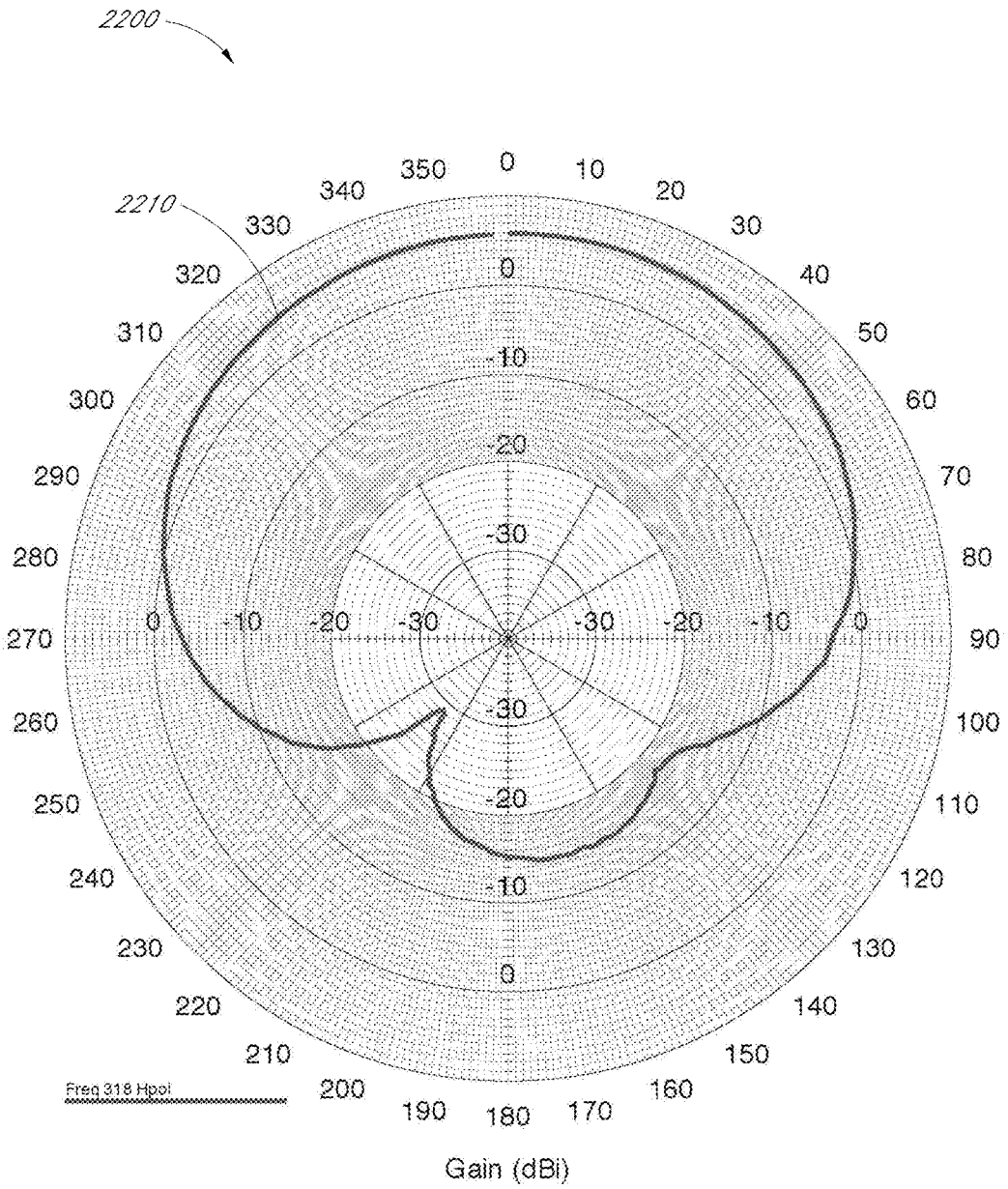

FIG. 14 illustrates an embodiment of flexure elements 1452, which can be used in place of the pivot elements 150 described above. While the flexure elements 1452 are shown connecting the antenna elements 110 to the base 130, similar flexure elements (or variations thereof) can also be used to connect the antenna elements 110 to the end cap 102. The flexure elements 1452 can advantageously flex by virtue of a leaf spring 1456 in each element 1452, thereby allowing the antenna elements 110 to move from one configuration to another.

As shown, the flexure elements 1452 can include element receptacles 1454, leaf springs 1456, and mounting members 1460. Each element receptacle 1454 attaches an antenna element 110 to a leaf spring 1456. The element receptacle 1454 is attached to the leaf spring 1456 by fasteners 1466 via holes in the receptacle 1454 and leaf spring 1456. Any suitable fastener or fasteners can be used, such as screws, bolts, pins, rivets, or the like. The leaf spring 1456 is in turn fastened between two portions 1462, 1464 of the mounting members 1460 by fasteners 1472, which can be any suitable fastener as described above. Each of the element receptacles 1454, leaf springs 1456, and mounting members 1460 may be made of metal so as to be conductive. Like the pivot elements 150, any gaps in the flexure elements 1452 can produce capacitive coupling, which can allow RF signals to pass to and from the antenna elements 110. In one embodiment, the flexure elements 1452 are anodized for concealment purposes, except that at least a portion of the leaf spring 1456 and holes in the elements 1452 are not anodized to allow current to pass through.

V. Example SATCOM Radiation Patterns

FIGS. 15 through 22 illustrate plots 1500-2200 of example electromagnetic radiation patterns 1510-2210 for the CP/SATCOM mode of the dual-polarized antenna. The example patterns 1510-2210 are shown for different transmit/receive frequencies. As shown, the patterns 1510-2210 are substantially omnidirectional with radiation predominantly in elevation angles (0 to 90 deg), while the patterns 1510-2210 indicate substantially attenuated radiation in the reverse direction (90 to 180 deg). In one embodiment, these substantially omnidirectional patterns allow the antenna to communicate in a vertical orientation with almost any satellite, without having to point the antenna at the satellite. Thus, a soldier or other user can simply mount the antenna vertically on his or her person or other equipment to achieve satellite communication. Users therefore do not need to know where satellites are positioned to communicate with them.

Advantageously, this omnidirectional or substantially omnidirectional upper hemispherical pattern is achieved in certain embodiments because the antenna elements are twisted in the opposite orientation than the elements are driven electrically. For example, the antenna elements can be twisted with a left-hand orientation and be driven with right-hand circularly-polarized (RHCP) radiation. Alternatively, the antenna can be twisted with a right-hand orientation and driven with LHCP radiation to achieve the same or similar radiation patterns.

In some embodiments, driving the antenna in the expanded quadrifilar mode in the same polarization as the direction of twist (e.g., RHCP and right-hand twist) can cause the antenna to emit a narrow, high gain beam off the top of and along the axis of the antenna. In contrast, driving the antenna with the opposite polarization as the direction of twist can provide a wider, lower gain (e.g., omnidirectional or substantially omnidirectional) pattern as described above.

The antenna driving circuitry can switch between polarizations while the antenna is deployed in SATCOM mode to enable a soldier to communicate in a LOS mode without collapsing the antenna (e.g., to avoid detection by avoiding movement or sound). LOS performance in the expanded mode of the antenna may or may not be degraded relative to the collapsed LOS mode of the antenna. A switch in the base 130 may be provided for making the change from SATCOM to LOS mode. In another embodiment, the polarization need not be changed when communicating in SATCOM and LOS modes while the antenna is deployed, although performance may be degraded.

VI. Soldier Mounting and Tripod Base

Figure 10:
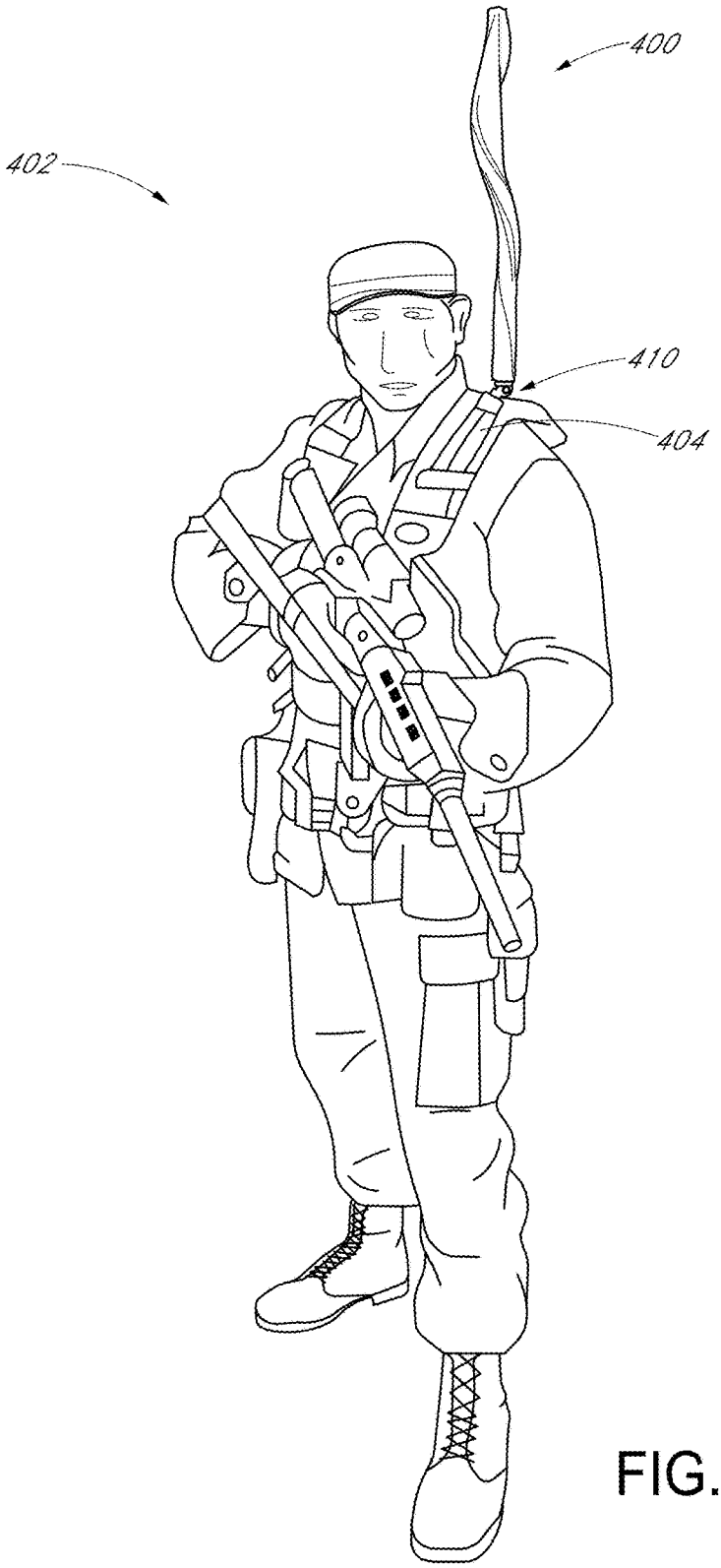
FIG. 10 illustrates an embodiment of the dual-polarized antenna mounted on a soldier in a collapsed LOS mode.

There are many ways that the antenna can be used by soldiers or other users, one of which is illustrated in FIG. 10 (other options are described below with respect to FIGS. 24 and 25). In FIG. 10, an embodiment of the antenna, namely the antenna 400, is connected to a vest 404 of a soldier 402. An attachment mechanism 410 can be connected to a support tube attached to fabric loops sewn on the back of the vest 404, slipped into a pocket of the vest 404, or otherwise attached to the vest 404. This attachment mechanism 410, described in greater detail below, can include a pivot that allows the antenna 400 to pivot downwards (e.g., toward the soldier's 402 chest or back) to move the antenna 400 out of the way of trees, other equipment, etc. The antenna 400 can still work in this position, but may also be pivoted upwards in the vertical or substantially vertical position shown for better reception in some embodiments.

For illustrative purposes, the antenna 400 is shown in the collapsed LOS configuration. As the antenna 400 is vertical with respect to the soldier 402 (and the ground), the antenna 400 is vertically polarized. When the antenna 400 is in the deployed SATCOM configuration, the soldier 402 can pivot the antenna 400 in an orientation to generally point in the direction of low-earth orbit (LEO) or geosynchronous orbiting (GEO) satellites.

Figure 11:
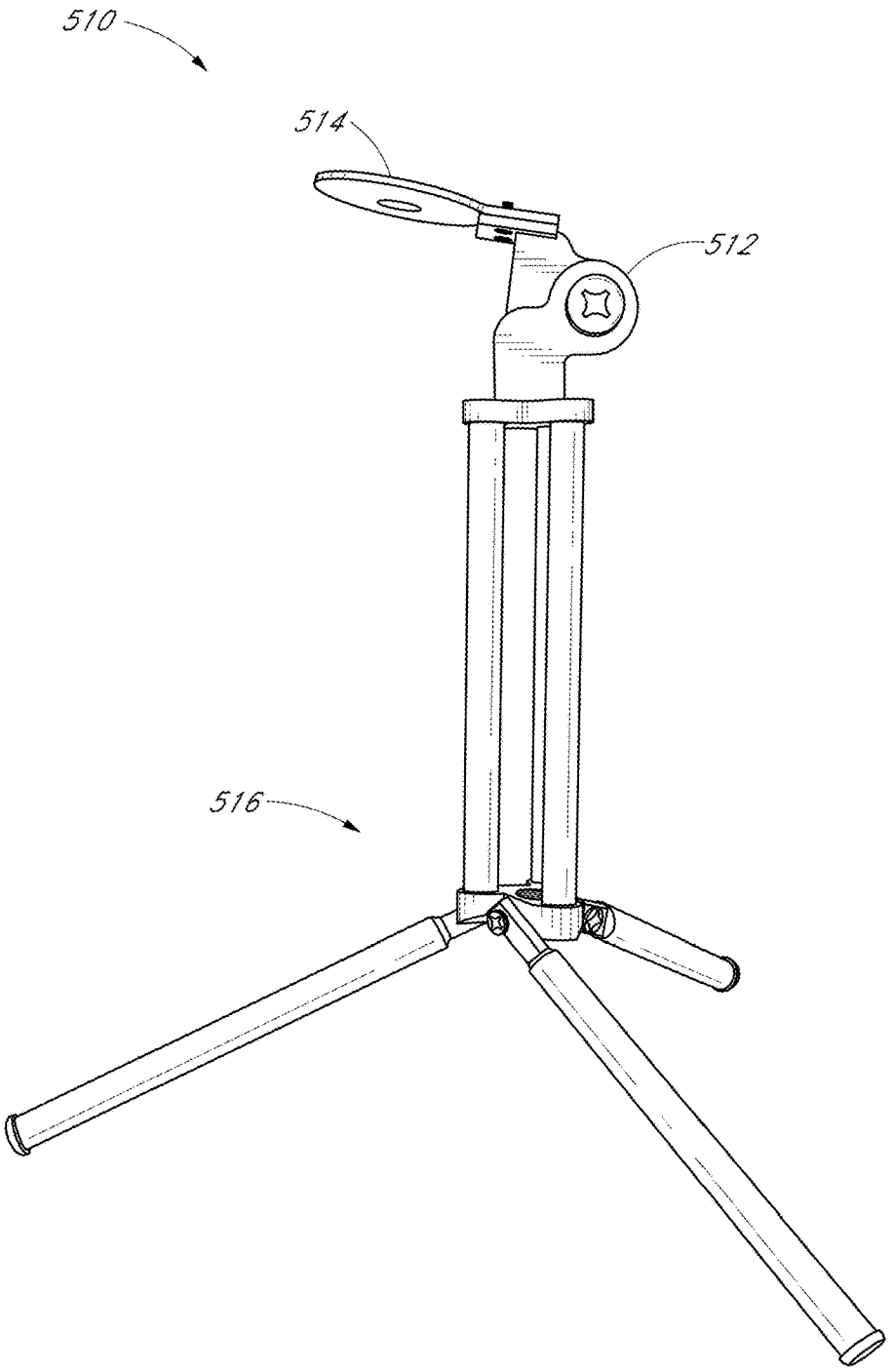
FIG. 11 illustrates an embodiment of a tripod base in an expanded configuration, which can be attached to a base of the dual-polarized antenna for use in certain embodiments when not deployed on a soldier.

FIG. 11 illustrates a more detailed embodiment of the attachment mechanism 410 of FIG. 10, namely an example attachment mechanism 510. This attachment mechanism 510 includes a pivot member 512 and a base attachment plate 514. The base attachment plate 514 can attach to the bottom of the base (e.g., 130) of any of the antennas described herein. The tripod 516 provides a stable support platform for the antenna to be placed on the ground or other surface, and the pivot member 512 allows the antenna to be pointed in substantially any direction.

Figure 12:
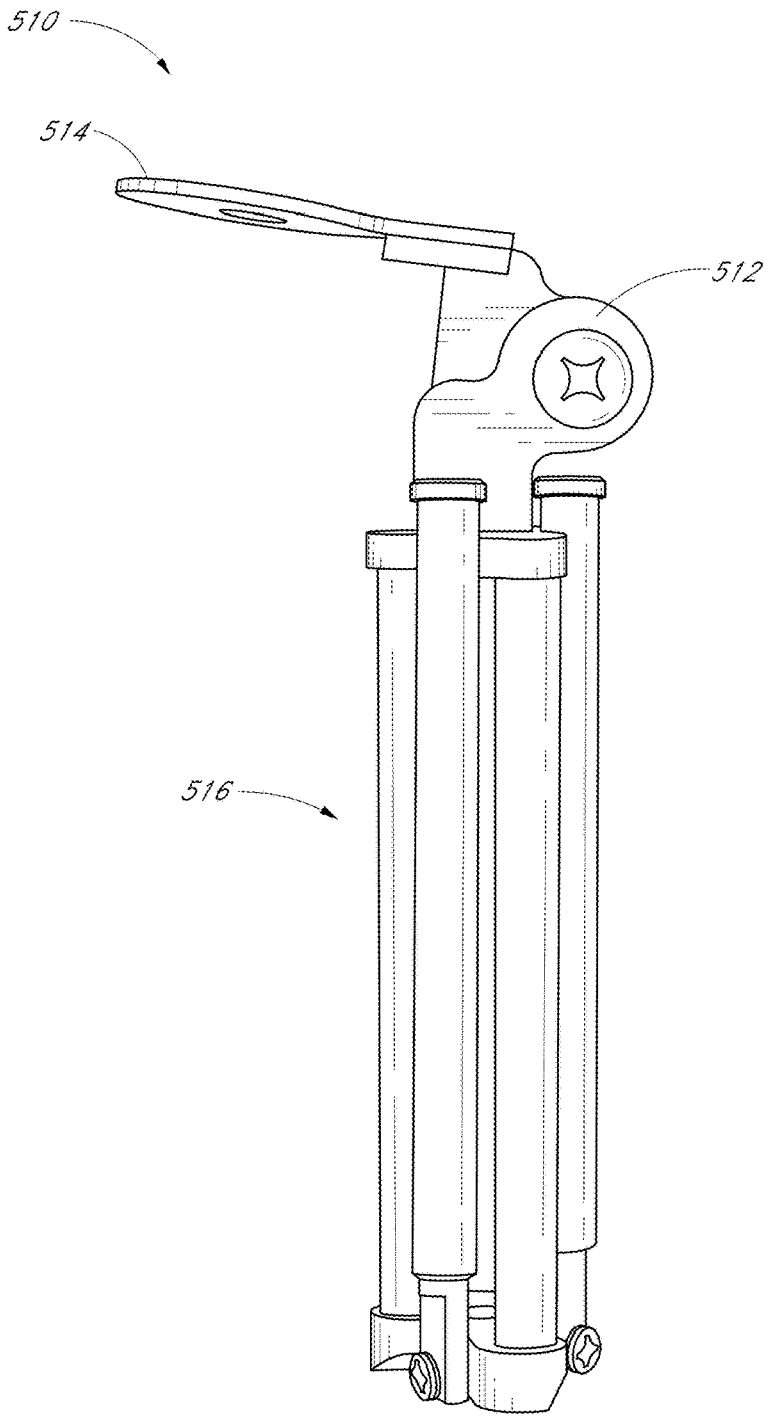
FIG. 12 illustrates another embodiment of the tripod base of FIG. 11, in a collapsed configuration.
Figure 13:
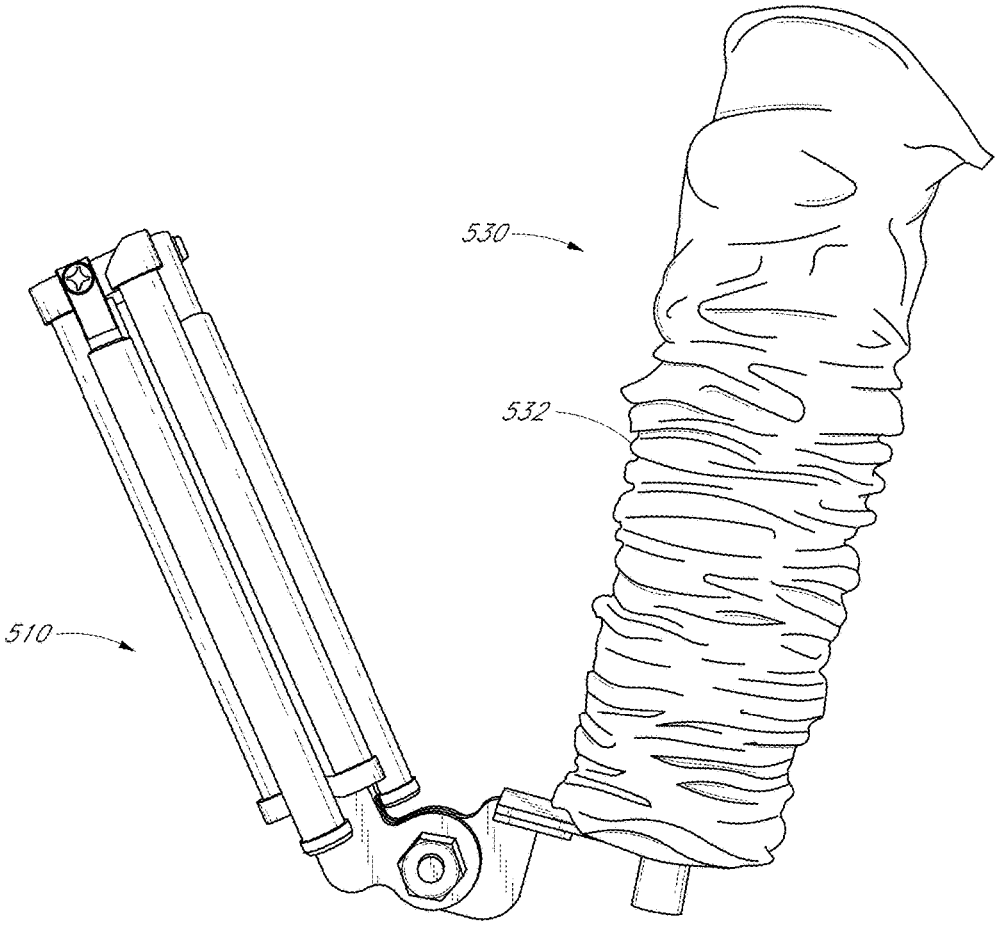
FIG. 13 illustrates an embodiment of the tripod base of FIGS. 11 and 12, connected to a base of the dual-polarized antenna.

The tripod 516 is collapsible, as shown for example in FIG. 12. Legs 518 of the tripod are collapsed against a support structure 522 of the tripod 516. In this configuration, the collapsed tripod 516 can be inserted into a vest pocket or backpack or strapped onto another article of clothing, vehicle, building, etc. In addition, the collapsed tripod 516 can be held in a soldier's hand. To place the tripod 516 in context, an example connection of the tripod 516 to a base 530 (corresponding to the base 130) of an antenna is shown in FIG. 13. For ease of illustration, the remainder of the antenna is not shown, although it may be attached to the base 530. The base 530 is also illustrated with a slip cover 532 covering the base. The base attachment plate 514 attaches the attachment mechanism 510 to the base 530. A hole in the base attachment plate 514 (see FIG. 11) allows an electrical connector 570 to pass through for connection to a radio. The tripod and/or base can act as a handle of the antenna.

VII. Example Hingeless Antenna and Hard Case

FIGS. 23A through 23C depict another embodiment of a dual-polarized antenna 2300. The antenna 2300 includes many of the features of the antenna 100 described above, such as an end cap 2302, antenna elements 2310, a base 2330, and an electrical connector 2370. Each of these components can have any of the features described above (or below). A difference between the antenna 2300 and the antenna 100 is that the antenna 2300 does not have pivot elements 150 or flexure elements 1452. Instead, the antenna elements 2310 are shaped to create bends 2350 in the elements 2310 near the base 2330 and end cap 2302, which facilitate the ends of the elements 2310 being inserted directly into the base 2330 and end cap 2302. The bends 2350 in the elements 2310 can be more rigid and stable than the pivot and flexure elements described above, with fewer points of failure in some embodiments.

Figure 24:
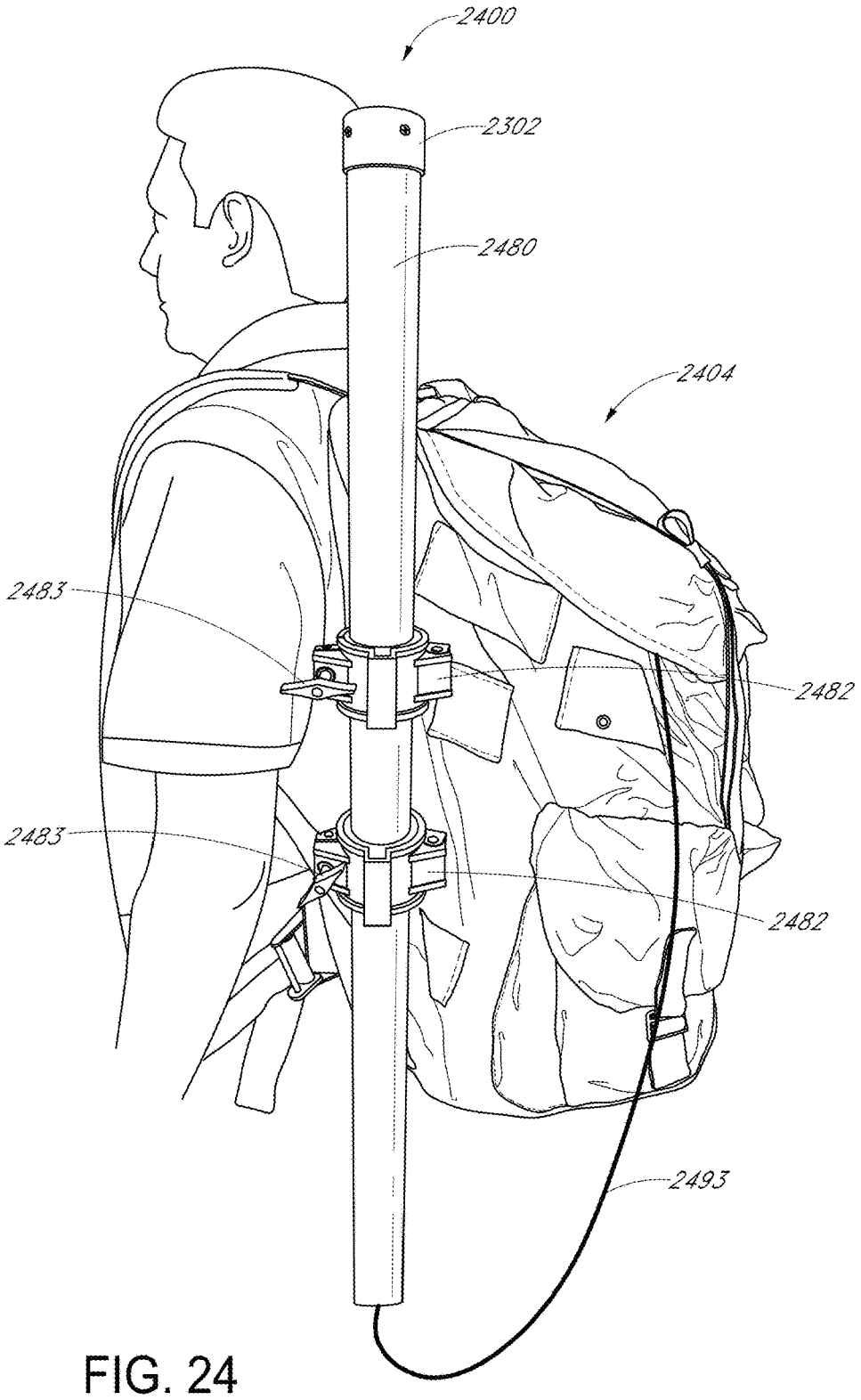
FIG. 24 depicts an embodiment of a tube case configured to cover the dual-polarized antenna, mounted on a soldier in a collapsed LOS mode.

FIG. 24 depicts an embodiment of a case or tube 2480 configured to cover the dual-polarized antenna, mounted on a soldier in a collapsed LOS mode. Either the antenna 100 or 2300 can be disposed in the tube 2480. For convenience, the remainder of this description will refer to the antenna 2300, although it should be understood that the antenna 100 may be used interchangeably.

In the depicted embodiment, the tube 2480 is a hard, cylindrical tube, as opposed to the soft, fabric cylindrical sleeve tube described above. The tube 2480 can be made of plastic, nylon, or any other suitable radiation-permeable material. The antenna 2300 is mostly enclosed by the tube 2480, although the end cap 2302 of the antenna 2300 sticks out above the top of the tube 2480. The antenna 2300 is therefore collapsed inside the tube 2480 and may operate in LOS mode in this configuration. The end cap 2302 can be grabbed and pulled by the user to pull the antenna elements at least partially out of a top opening of the tube to cause the antenna elements to expand for SATCOM operation, as shown in FIG. 25. A hook or other handle can be connected to the end cap 2302 in an embodiment for easy pulling by a soldier.

Figure 25:
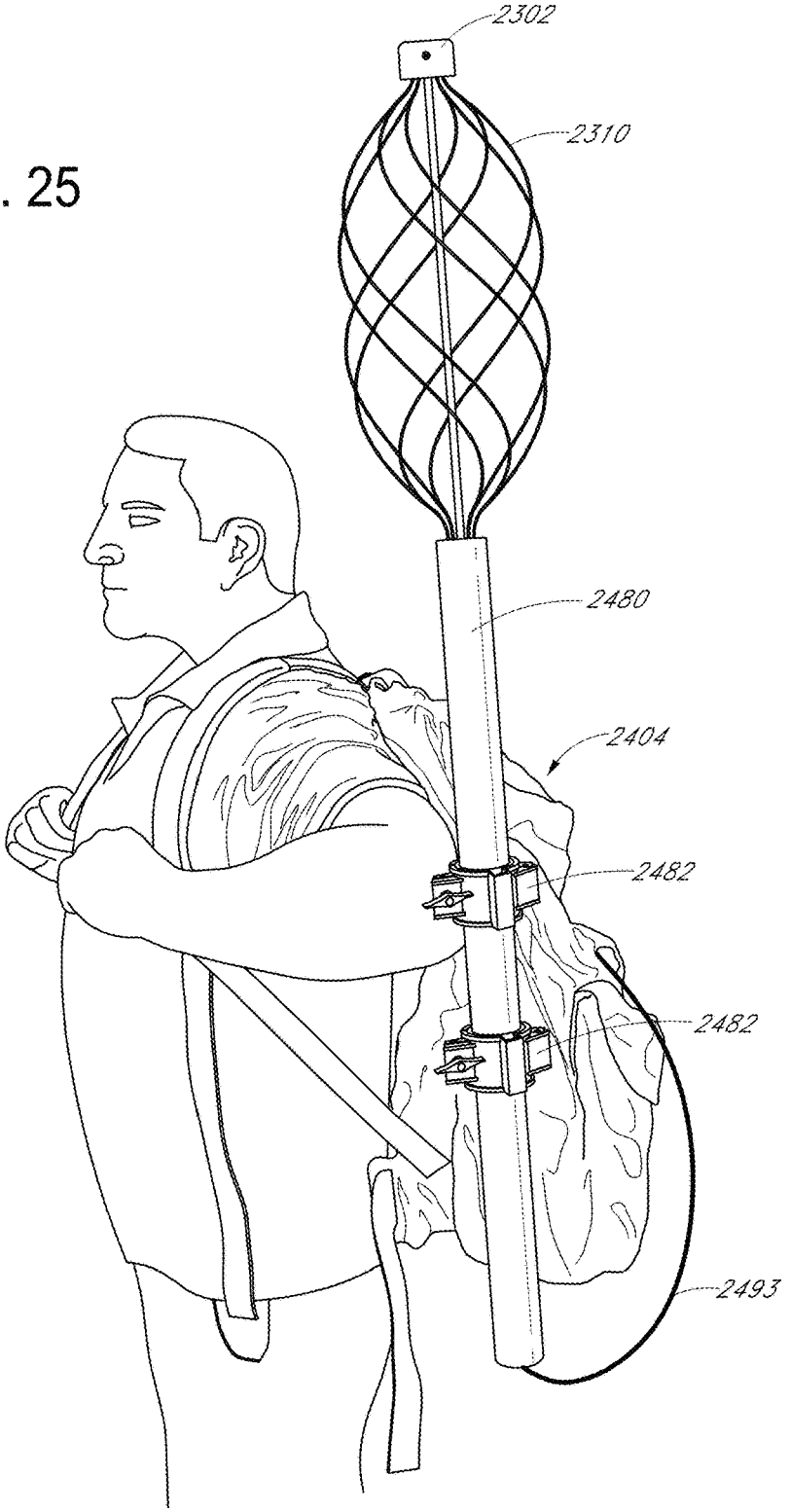
FIG. 25 depicts the dual-polarized antenna in the tube of FIG. 24, mounted on a soldier in an expanded SATCOM mode.

With continued reference to FIGS. 24 and 25, a cable 2493 attached to the electrical connector 2370 at the base 2330 of the antenna 2300 protrudes through a bottom opening of the tube 2480. The user of FIG. 25 can pull on the cable 2493 to retract the antenna elements 2310 into the tube 2480 to achieve the LOS configuration of FIG. 24. A motorized antenna retraction and deployment mechanism can also be included in the tube 2480 in some embodiments.

The tube 2480 is connected to a backpack 2404 of the user via clamps 2482 that clamp both around the tube 2480 and around a metal tubular frame of the backpack 2404 (not shown). Wing nuts 2483 allow the clamps 2482 to be opened so that the tube 2480 may be removed from the backpack. The tube 2480 could, in other embodiments, be connected directly to an article of clothing of the user, to a vehicle, or to any structure.

Figure 26:
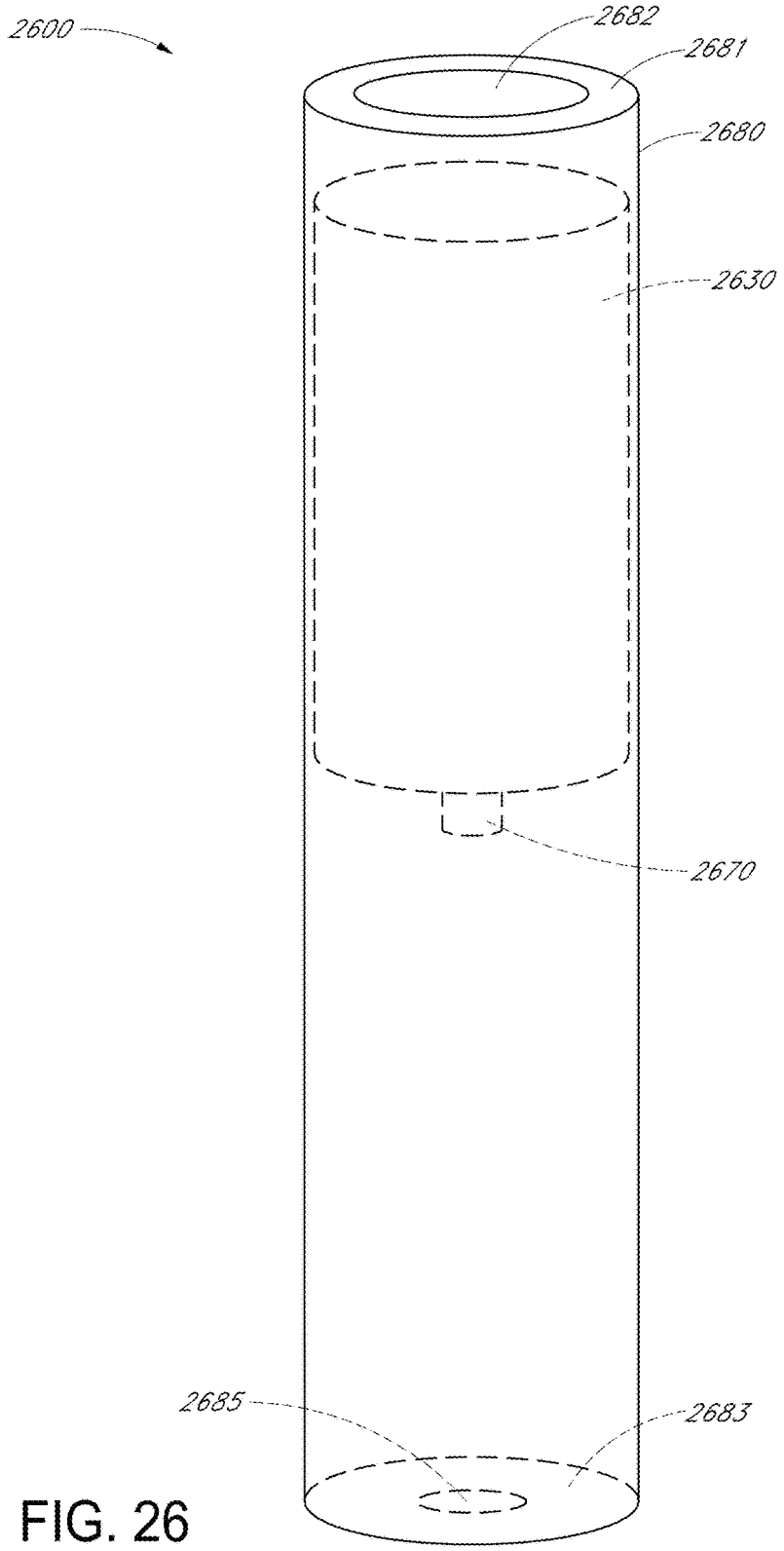
FIG. 26 depicts another embodiment of a tube for the dual-polarized antenna.

FIG. 26 depicts another embodiment of a tube 2680 for the dual-polarized antenna. In this embodiment, the tube 2680 is drawn schematically and includes a portion of the antenna 2300 disposed therein, namely a base 2630 of the antenna. The base 2630 is drawn in phantom to indicate its presence inside of the tube 2680 and would normally not be seen from the current view when inside the tube 2680. An electrical connector 2670 is show at the bottom of the base 2630.

The tube 2680 allows the base 2630 to move slidably up and down within the tube to effectuate the deploying and collapsing of the antenna elements, respectively. In some embodiments, it is desirable to not allow the antenna 2300 to come completely out of the tube 2680. Accordingly, a lip 2681 is provided at the top of the tube 2680 that engages with and prevents a top surface 2631 of the base 2630 from protruding outside of the tube 2680. Although the base 2680 cannot be removed in this depiction, antenna elements connected to the base 2630 (not shown) can protrude through a hole 2682 defined by the lip 2681 of the tube 2680. Similarly, the bottom surface of the base 2630 is blocked from protruding at the bottom of the tube 2680 by a lip 2683 that defines a hole 2685 having a smaller diameter than the diameter of the tube 2680.

In other embodiments, the inside surface of the top and/or bottom of the tube 2680 can include one or more detents (or a detent ring) that prevents the base 2630 from protruding outside of the tube unless sufficient force is supplied to move the base 2630 over the detent. A leaf spring may be used in place of a detent to obtain a similar effect.

VIII. Example Antenna Base Features

Figure 27:
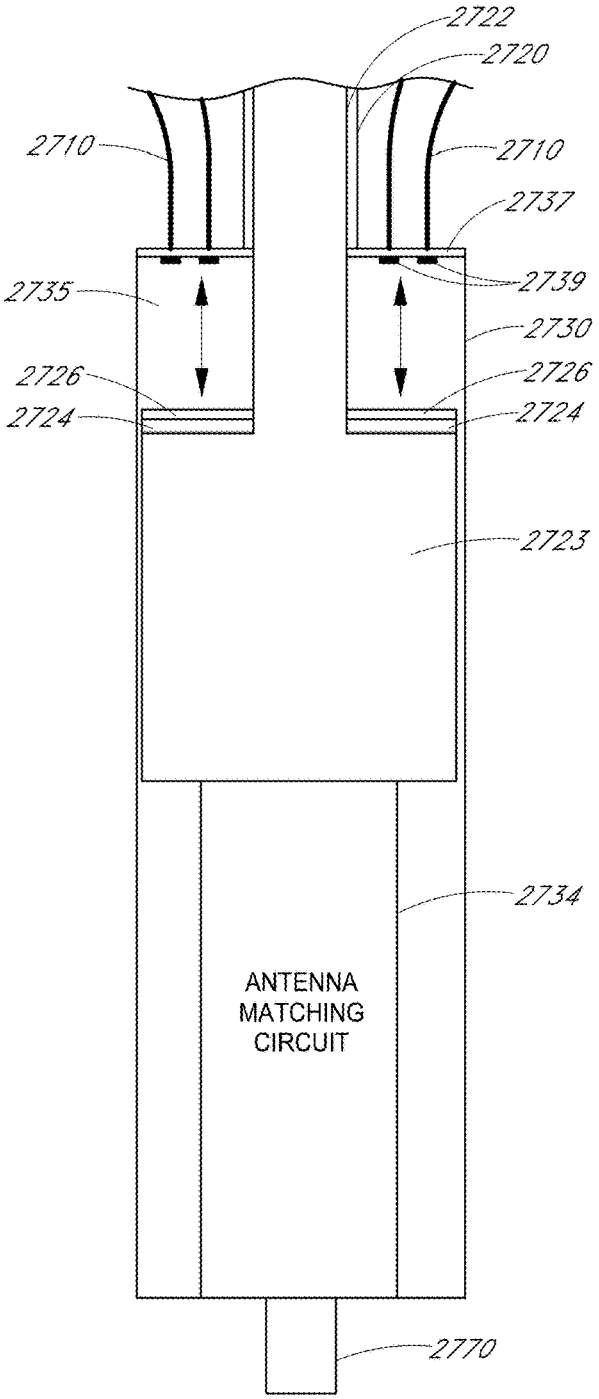
FIG. 27 depicts an embodiment of a base of the dual-polarized antenna.

FIG. 27 depicts an embodiment of an interior of a base 2730 of the dual-polarized antenna. As mentioned above with respect to FIG. 8, the sliding rod 322 within the mast 120 of the antenna can actuate an antenna mode switch 332 in the base of the antenna. In the base 2730 of FIG. 27, the actuation of a sliding rod 2722 within a mast 2720 also facilitates switching antenna modes.

In FIG. 27, the sliding rod 2722 is connected to a sliding cylinder 2723 that moves slidably up and down within the base 2730 (as indicated by arrows within the base 2730). The sliding cylinder 2723 is also in communication with an antenna matching circuit 2734. The sliding action of the sliding cylinder 2723 can actuate the antenna matching circuit 2734 to switch between SATCOM matching and LOS matching. A more detailed mechanical mechanism for performing this switching is described below with respect to FIG. 28.

The sliding action of the cylinder 2723 also facilitates shorting the antenna elements 2710 together to enter LOS mode. As described above, the antenna elements 2710 can be driven separately (e.g., at different phases) in SATCOM mode while being driven together as a lumped element or single conductor in LOS mode. The cylinder 2723 can short all (or some of) the elements 2710 together in the LOS mode. When in the LOS mode, the sliding rod 2722 of the mast 2720 is pulled upwards to cause the antenna elements 2710 to collapse against the mast 2720. This upward pulling of the sliding rod 2722 also pulls the sliding cylinder 2723 upward within an annular void 2735 of the base 2730 until the sliding cylinder 2723 is in contact with the top of the interior of the base 2730.

A conductive layer 2726 of material is disposed at the top of the sliding cylinder 2723. This conductive layer 2726 may be an annular film or layer. When pulled against the interior top of the base 2730 by action of the sliding rod 2722 and cylinder 2723, this conductive layer 2726 can come into contact with conductive pads 2739 disposed on the bottom of a circuit board 2737 to which the antenna elements 2710 are affixed. The conductive layer 2726 can therefore short the conductive pads 2739 together so that the antenna matching circuit 2734 can drive the antenna elements 2710 as a single, LOS conductor. A compressive layer 2724 made of foam or other compressible material disposed underneath the conductive layer 2726 and on top of the sliding cylinder 2723 can facilitate compression of the conductive layer 2726 against the conductive pads 2739.

Sliding the sliding rod 2722 downwards within the mast 2720 can push the cylinder 2723 and therefore conductive layer 2726 away from the conductive pads 2739, thereby allowing the antenna elements 2710 to be driven separately in SATCOM mode.

Figure 28A:
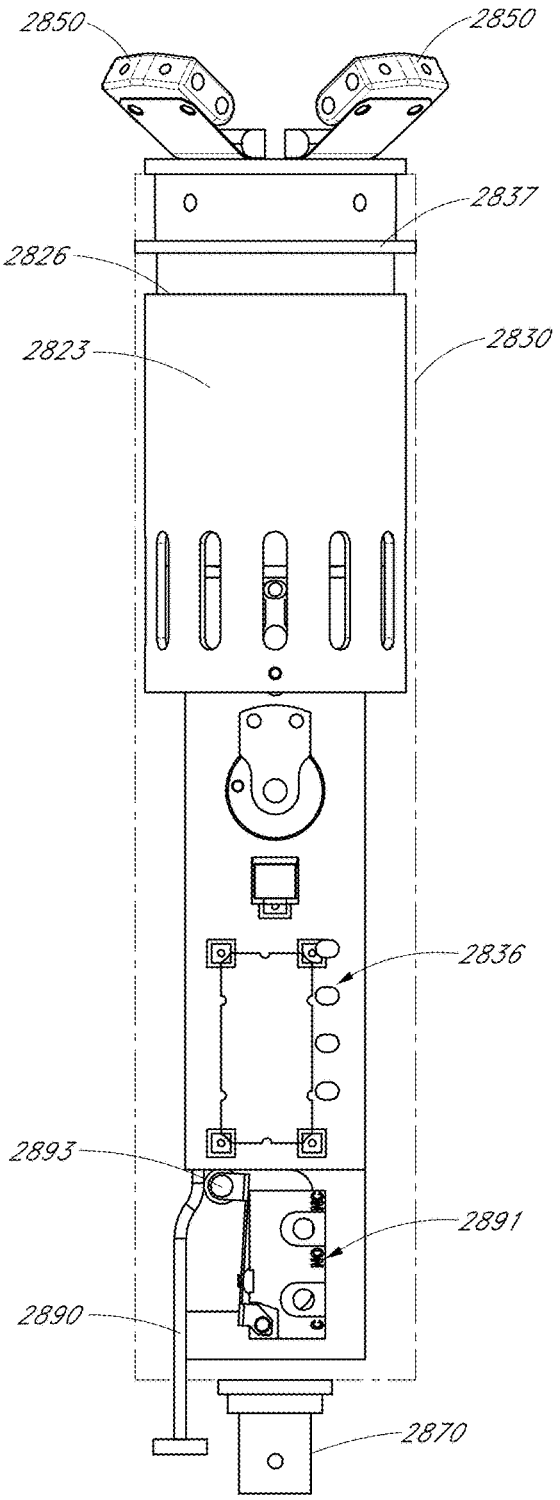
FIGS. 28A, 28B, and 28C depict another embodiment of a base of the dual-polarized antenna.
Figure 28B:
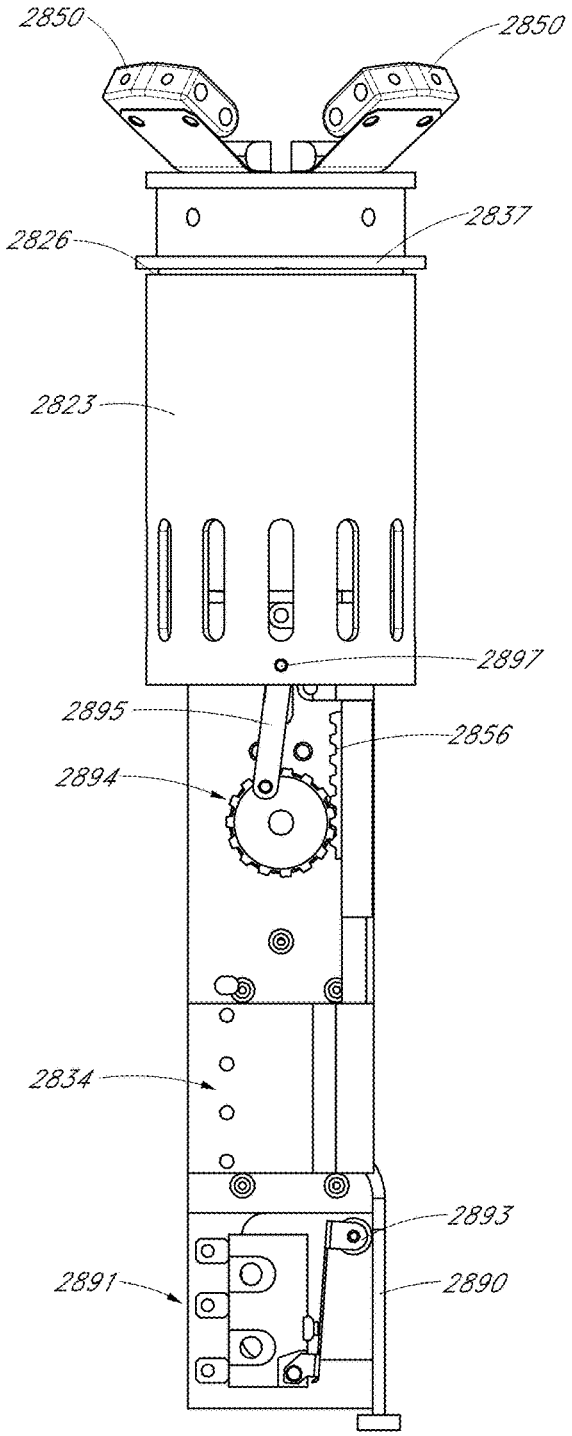
Figure 28C:
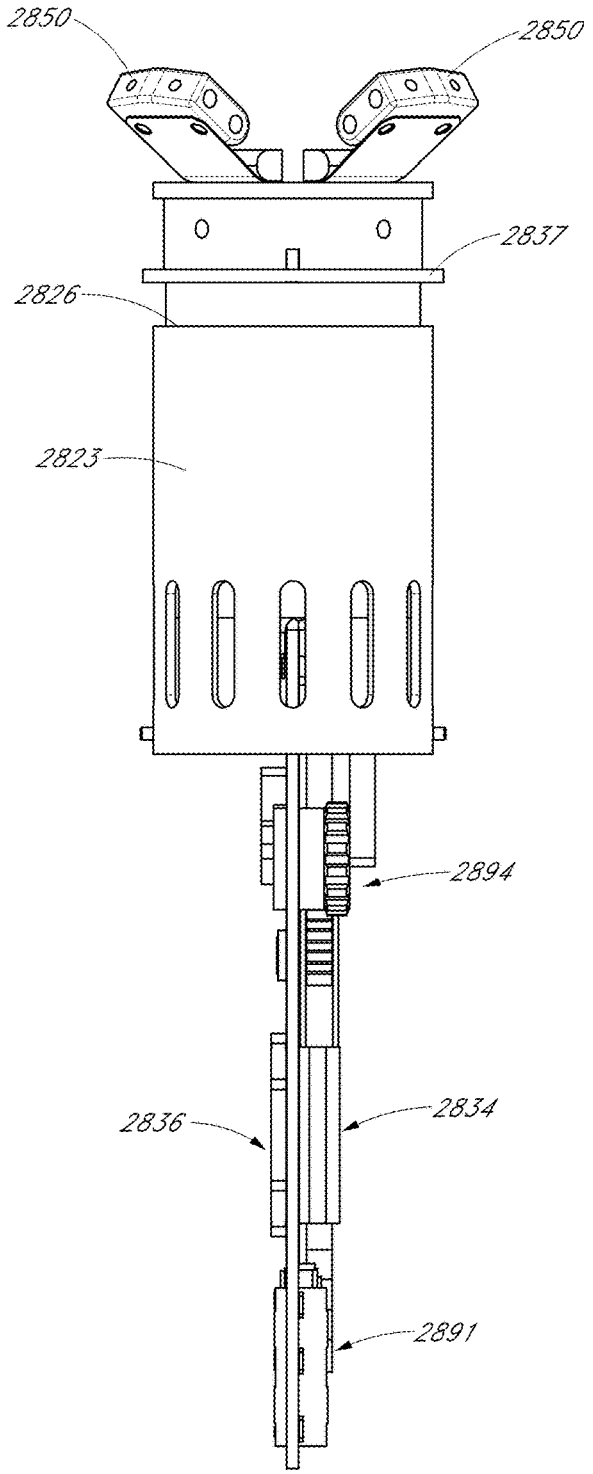

FIGS. 28A, 28B, and 28C depict a more detailed embodiment of an interior of a base 2830 of the dual-polarized antenna. In FIG. 28A, the exterior wall of the base 2830 is shown, but this exterior wall is absent in FIGS. 28B and 28C. This embodiment depicts the base 2830 connected to the flexure elements 2850, which in turn may attach to antenna elements (not shown). However, pivotal elements or bent antenna elements (as in FIG. 23) may be used in place of the flexure elements 2850 in other embodiments.

Like the base 2730, the base 2830 includes a sliding cylinder 2823 that can move slidably up and down to selectively come into engagement with a printed circuit board 2837. The top surface 2826 of the sliding cylinder 2823 can include a conductive material that shorts out pads (not shown) on the bottom of the circuit board 2837 when the cylinder 2823 is engaged with the circuit board 2837. Likewise, the top surface 2826 of the sliding cylinder 2823 can include the compressive layer 2724 of FIG. 27. The sliding rod, although not shown, can be connected to the sliding cylinder 2823 to effectuate the up and down movement of the cylinder 2823.

Referring to FIG. 28B, the sliding cylinder 2823 is connected to a rack 2856 and pinion 2894 via an armature 2895 (connected to the pinion). As the cylinder 2823 slides up and down within the base 2830, the pinion 2894 moves along the rack 2856 due to the pinion 2894 being connected to the armature 2895. The rack 2856 and pinion 2894 provides friction resistance to the movement of the cylinder 2823 in some embodiments, thereby causing the cylinder 2823 to be firmly engaged with the circuit board 2837. In one embodiment, sliding the sliding cylinder 2823 upwards causes the armature 2895 to move to the right (with respect to the FIGURE) of the center of the pinion 2894. As a result, shock and vibration cannot easily reverse the position of the pinion 2894 and cause the cylinder 2823 to move downwards away from the circuit board 2837. Downward pressure on the armature 2895 from shock or vibration may cause the armature 2895 to push down on the pinion 2894, such that the pinion 2894 would attempt to rotate upwards (toward the sliding cylinder 2823) along the rack 2856. However, this movement of the pinion 2894 would serve to tighten the sliding cylinder 2823 against the circuit board 2837. The connection between the conductive surface atop the cylinder 2823 and the pads of the circuit board 2837 can therefore remain close or tight despite some jostling or vibration of the antenna. A user can actuate the sliding arm 2890, which can be connected to the rack 2856, to move the rack 2856 upwards, causing the pinion 2894 to roll in the opposite direction to movement of the rack 2856. This movement of the pinion 2894 can move the armature 2895 over to the left of center of the pinion 2894, effectively unlocking the cylinder 2823 to slide downwards and disengage from the circuit board 2837.

A SATCOM switching circuit 2836 is shown on one side of the base 2830 in FIG. 28A, and an LOS switching circuit 2834 is shown on the other side of the base 2830 in FIG. 28B. FIG. 28C shows an end view of the base 2830, rotated 90 degrees from FIGS. 28A and 28B so that the SATCOM switching circuit 2836 is shown on the left while the LOS switching circuit 2834 is shown on the right. A microswitch 2891 is in electrical communication with both switching circuits 2834, 2836 and can be automatically actuated by the movement of the sliding cylinder 2823 to select between use of the different switching circuits 2836, 2834. The microswitch 2891 includes an arm 2893 that is coupled with a sliding arm 2890 that is coupled with the rack 2856 and pinion 2894. When the pinion 2894 moves upward with the cylinder 2823 (into LOS mode), the arm 2890 moves upward as shown in FIG. 23B, causing the arm 2893 of the microswitch 2891 to be pulled away from the microswitch 2891 (deactivated), selecting the LOS switching circuit 2834. Conversely, when the pinion 2894 moves downward with the cylinder 2823 (into SATCOM mode), the arm 2890 moves downward, and a bend in the arm 2890 depresses the arm 2893 of the microswitch 2891, selecting the SATCOM switching circuit 2836. The arm 2890 can also be manually actuated, as shown in FIG. 28A, by being pressed or pulled by the operator/soldier.

In some embodiments, the rack 2856 and/or pinion 2894 can be exposed outside of the base 2830 (e.g., through a window in the base 2830) for thumb-slide manual activation by a user. In yet another embodiment, the actuation arm 2890 can be connected to a solenoid in the base 2830 that is in turn in electrical communication with a radio connected to the base 2830 so that the radio can send a switching signal to actuate the solenoid when changing communications modes. A camera type cable release can also be attached to the base 2830 so that a soldier can switch from his chest area or gun support hand area, rather than by having to touch the base 2830.

IX. Other Embodiments and Features

In addition to the embodiments shown, many other configuration of the dual-polarized antenna are possible. For instance, in some embodiments one or more spacers (such as plastic or nylon spacers) can be fastened to the pairs of antenna elements 110 to provide rigidity to the antenna elements 110. An antenna element covering may also be provided to cover the antenna elements 110 in both the LOS and SATCOM positions. This covering can be a cloth covering or the like that can fit under the slip cover, and which may reduce potential snagging of the antenna elements on bushes, trees, or other equipment. The antenna element covering can be transparent, translucent, black, camouflage, have netting, or the like to reduce visibility of the antenna.

Although a slip cover 280 is shown as the mechanism for converting from collapsed to deployed configuration and vice versa, a different mechanism may be used to accomplish this conversion in other embodiments. For instance, referring to FIG. 8, a locking mechanism can be included in the support structure 300 to lock the sliding rod 322 in the mast 320 at an extended position, which can cause the antenna elements to be held collapsed against the mast 120 without a cover. An example of a locking mechanism can be a spring-loaded pin or the like that locks into place when the sliding rod 322 reaches a certain height with respect to the mast 120. The locking mechanism can be actuated to an unlocked position. The spring-loaded antenna elements can then pull the sliding rod toward the base 130 automatically, causing the antenna to convert to the SATCOM configuration. The locking mechanism can be electronically actuated in some embodiments.

In still other embodiments, the antenna elements need not be pre-shaped but instead can be twisted into the proper shape either manually or via a mechanism in the support structure. This mechanism may be a groove, set of grooves, or the like that the sliding rod twists into as the sliding rod is pushed into the mast (e.g., by a user pushing on the end cap). The sliding rod may have screw grooves to match the grooves in the mast. As the sliding rod twists into the grooves, the end cap can twist and thereby twist the antenna elements. The sliding rod can lock into place via a locking mechanism in the mast, such as is described above, to lock the antenna in the quadrifilar SATCOM configuration. Other configurations are also possible.

Moreover, any cover or mechanism can be used that allows the antenna elements to collapse, instead of the soft and hard covers shown. For instance, the cover can be a hard plastic or metal telescoping shell, a clamshell, or a hook-and-loop fastener (e.g., Velcro™) that wraps around the antenna elements, or any combination of the same.

The base may include various types of electronic circuitry. As described above, some of this circuitry can optionally include passive (or active) analog matching networks. Matching circuitry can be omitted from the base, however, if a separate antenna tuner is connected to the antenna or is provided in an attached radio. Functionality, the base can include any analog or digital circuitry, including optionally one or more microprocessors for performing various functions. Further, the base can include electromechanical components, such as motors, relays, or other actuators or switches. Several examples of base features will now be described, although it should be understood that the described examples are not exhaustive. Furthermore, the circuitry described herein can be attached to another component of the antenna other than the base in some embodiments.

In one embodiment, the base includes a diplexer that can facilitate half or full-duplex communications with a remote device. This diplexer can facilitate radio communications with the Mobile User Objective System (MUOS) of GEO satellites, among other systems. In another embodiment, the base includes a transmit/receive sensing module. This electronic module can detect when a signal is sent from a radio to the antenna for transmit and automatically select a matching network efficient for transmission. At other times when the antenna is not transmitting, the antenna can switch to or default to a matching network that is more efficient for receiving. The matching networks can be selected to match for different frequencies, for example. In yet another embodiment, the base includes an automatic antenna tuning circuit or module that detects a frequency of transmission and automatically tunes the antenna to match that frequency.

Such a tuning module can advantageously enable better antenna matching in frequency hopping and spread-spectrum communications.

Another feature that can be included in the antenna in certain embodiments is an automatic mode change module. The mode change module can include an electric motor, one or more actuators, and associated circuitry that can automatically change the antenna from SATCOM configuration to LOS configuration and vice versa. In one embodiment, the mode change module can automatically change the antenna from one configuration to another based on a frequency dialed in by a user on a radio, or by a frequency of transmission detected, or by some option selected by a user from a user interface in the base or radio. This feature can be especially useful if the antenna is vehicle-mounted or building-mounted. The base can also include a full radio in some embodiments, which may optionally have a screen or other user interface. Thus, the antenna can be a self-contained communications system in some embodiments.

It should be noted that in some embodiments, when the antenna is in an expanded configuration, the elements can be driven together to achieve LOS mode and driven separately to achieve SATCOM mode. With the expanded configuration of the antenna able to radiate in either LOS or SATCOM mode, as described above, the antenna enables a soldier to use LOS and SATCOM communications without having to alternately collapse and expand the antenna. Moreover, in some embodiments, the sleeve or other collapsing mechanism can be omitted entirely. Further, the antenna can be designed with a fixed mast such that the antenna is fixed in the expanded configuration.

The electronics (such as antenna matching and/or drive circuitry) described herein as residing in the base may be disposed in the end cap or mast in some embodiments, instead of the base. Alternatively, portions of the electronics can be disposed in any combination of the end cap, mast, and base. In some embodiments, the base may be shortened substantially or substantially omitted entirely (e.g., a very thin structure for holding the antenna elements may be used in place of the base if the electronics in the base are instead in the mast or end cap).

X. Example Process of Fabricating Superelastic Wire Elements

As described above, the antenna elements may be made of memory metal or superelastic wire in some embodiments.

Metal alloys that have the shape memory effect include binary metals and trinary metals, such as some of the example metals described herein. The most common shape memory effect alloy utilized is the binary metal of nickle and titanium in close to equal amounts. The basis of the shape memory effect is that these alloys undergo a change in their crystal structure as they are cooled and heated through a temperature called the transformation temperature TTR. Extreme elasticity or superelasticity occurs at temperatures above the transformation temperature because the crystal structural transformation can be caused by stress. As the deformation occurs, a structural transformation happens, but then reverses as the stress is reduced and the structural transformation reverses. The type of transformation is known as a thermoelastic martensitic transformation and changes the material from the higher temperature form called austenite.

In other words, superelasticity can occur when shear stress is applied to an austenitic alloy to cause it to transform to deformed martensite in a way that relieves the applied stress. When the stress is relieved, the material reverts back to austenite. This is repeatable because the deformation in the martensite mode is non-damaging to the crystal structure. In normal metal alloys, deformation by atomic slip has no memory and does not reverse itself and results in work hardening.

For a given alloy, with a specific heat treating process, under specific stress conditions, this transformation temperature (TTR) occurs at a repeatable temperature and superelasticity occurs over a repeatable temperature range. The temperature that superlasticity occurs and the range of temperature that superelasticity is exhibited over can depend on the composition of the alloy, how it is worked, and how it is heat treated during shape forming.

An ingot of the metal alloy material with a very low TTR can be made by a number of metal foundries. From this type of ingot, the antenna element wire can be drawn, which can result in typically 40% cold worked wire material. This cold worked wire material may show very poor or non-existent shape memory or superelasticity until it is heat-treated. This wire material can then be placed in a shaping form, such as a spiral, that holds the wire in the desired shape as the temperature is increased from room temperature to between about 300 degrees C. to about 600 degrees C. for between about 1 minute to about 10 minutes. The formed wire can be quenched rapidly back to room temperature using cool water or cool air. The result can be a shape-formed wire that has superelastic properties.

XI. Terminology

Many other variations than those described herein will be apparent from this disclosure. For example, depending on the embodiment, certain acts, events, or functions of any of the processes described herein can be performed in a different sequence, can be added, merged, or left out all together (e.g., not all described acts or events are necessary).

Certain illustrative logical blocks and modules described in connection with the embodiments disclosed herein can be implemented or performed by analog circuitry or a digital machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The steps of a method, process, or algorithm described in connection with the embodiments disclosed herein can be embodied directly in hardware, in a software module executed by a processor, or in a combination of the two. A software module can reside in memory or any other form of non-transitory computer-readable storage medium or media. An exemplary storage medium can be coupled to the processor such that the processor can read information from, and write information to, the storage medium. In the alternative, the storage medium can be integral to the processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

What is claimed is:

1. An antenna comprising:

a support structure comprising:

a mast comprising a top end and a bottom end, an end cap attached to the top end of the mast, and a base attached to the bottom end of the mast; and an antenna element comprising a first end and a second end, wherein the antenna element is shaped to create a first bend at the first end and a second bend at the second end such that the first end of the antenna element is configured to be inserted into the top of the base, and such that the second end of the antenna element is configured to be inserted into the bottom of the end cap, wherein the antenna element is configured to be driven with right-hand circularly polarized (RHCP) radiation, and wherein a portion of the antenna element other than the first end and the second end is spaced away from the mast.

2. The antenna of claim 1, wherein the antenna element is shaped in a helix.

3. The antenna of claim 1, further comprising an attachment mechanism configured to attach the antenna to a backpack.

4. The antenna of claim 1, wherein a diameter of the end cap is larger than a diameter of the mast.

5. The antenna of claim 1, wherein a diameter of the base is larger than a diameter of the mast.

6. The antenna of claim 1, wherein the base is configured to facilitate communications via a mobile user objective system (MUOS).

7. The antenna of claim 1, wherein the base is coupled to an attachment mechanism that allows the antenna to be pointed in any direction.

8. The antenna of claim 1, wherein the antenna element comprises memory metal.

9. The antenna of claim 1, wherein the antenna element comprises titanium.

10. The antenna of claim 1, wherein the base is a cylinder.

11. An antenna comprising:

a support structure comprising:

a fixed mast, an end cap attached to a first end of the fixed mast, and a base attached to a second end of the fixed mast;

a first antenna element comprising a first end and a second end, wherein the first end of the first antenna element bends into the top of the base, and wherein the second end of the first antenna element bends into the bottom of the end cap; and a second antenna element comprising a third end and a fourth end, wherein the third end of the second antenna element bends into the top of the base, and wherein the fourth end of the second antenna element bends into the bottom of the end cap, wherein the first and second antenna elements are each twisted at least partially about the fixed mast without touching the fixed mast, such that the first and second antenna elements are configured to transmit circularly-polarized electromagnetic radiation.

12. The antenna of claim 11, wherein the first and second antenna elements each comprise titanium.

13. The antenna of claim 11, wherein the first and second antenna elements each comprise memory metal.

14. The antenna of claim 11, wherein the fixed mast is a tube.

15. The antenna of claim 11, further comprising an antenna matching circuit disposed in the base.

16. The antenna of claim 11, wherein the antenna is configured to communicate with one or more satellites.

17. The antenna of claim 11, wherein a maximum distance between the first antenna element and the fixed mast is greater than a radius of the end cap.

18. The antenna of claim 11, wherein a height of the fixed mast is greater than a radius of the fixed mast.

19. The antenna of claim 11, wherein the base is configured to facilitate communications via a mobile user objective system (MUOS).

20. The antenna of claim 11, wherein the end cap is a cylinder.

* * * * *